US008206881B2

(12) United States Patent
Obata et al.

(10) Patent No.: US 8,206,881 B2
(45) Date of Patent: Jun. 26, 2012

(54) ELECTROPHOTOGRAPHIC PHOTORECEPTOR AND IMAGE FORMING APPARATUS

(75) Inventors: Takatsugu Obata, Nara (JP); Akihiro Kondoh, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 416 days.

(21) Appl. No.: 12/266,759

(22) Filed: Nov. 7, 2008

(65) Prior Publication Data

US 2009/0129817 A1 May 21, 2009

(30) Foreign Application Priority Data

Nov. 16, 2007 (JP) ..... 2007-298137

(51) Int. Cl.
*G03G 5/043* (2006.01)

(52) U.S. Cl. ..... 430/58.35; 430/74; 430/970; 399/159

(58) Field of Classification Search ..... 430/58.35, 430/74, 970; 399/159
See application file for complete search history.

(56) References Cited

U.S. PATENT DOCUMENTS

| | | | | |
|---|---|---|---|---|
| 3,208,859 | A * | 9/1965 | Coffield | 426/544 |
| 3,692,679 | A * | 9/1972 | O'Neill | 508/383 |
| 4,952,470 | A | 8/1990 | Tamaki et al. | |
| 5,047,803 | A * | 9/1991 | Kanoto | 399/111 |
| 5,102,759 | A | 4/1992 | Fuse et al. | |
| 5,130,222 | A | 7/1992 | Otsuka et al. | |
| 7,122,284 | B2 * | 10/2006 | Kawamura et al. | 430/66 |
| 2001/0044518 | A1 * | 11/2001 | Hoffmann et al. | 528/108 |
| 2007/0154826 | A1 * | 7/2007 | Suzuki et al. | 430/59.5 |

FOREIGN PATENT DOCUMENTS

| | | |
|---|---|---|
| JP | 62-105151 | 5/1987 |
| JP | 63-4238 | 1/1988 |
| JP | 63-18355 | 1/1988 |
| JP | 63-216055 | 9/1988 |
| JP | 3-172852 | 7/1991 |
| JP | 5-158258 | 6/1993 |
| JP | 7-261414 | 10/1995 |
| JP | 2001-356500 | 12/2001 |

* cited by examiner

*Primary Examiner* — Janis L Dote
(74) *Attorney, Agent, or Firm* — Nixon & Vanderhye P.C.

(57) ABSTRACT

There provides an electrophotographic photoreceptor using a novel amine compound which has an excellent effect of ozone resistance and can be used for providing an electrophotographic photoreceptor having no adverse effect on other characteristics, and an image forming apparatus including the photoreceptor. The aim is attained by an electrophotographic photoreceptor formed by stacking a single layer type photosensitive layer containing a charge generating material and a charge transporting material, or a layered photosensitive layer, in which a charge generation layer containing a charge generating material and a charge transporting layer containing a charge transporting material are stacked in this order, on a conductive substrate made of a conductive material, wherein the single layer type photosensitive layer or the charge transporting layer of the layered photosensitive layer contains a specific amine compound.

6 Claims, 4 Drawing Sheets

ELECTROPHOTOGRAPHIC PHOTORECEPTOR AND IMAGE FORMING APPARATUS

CROSS-REFERENCE TO RELATED APPLICATION

This application is related to Japanese Patent Application No. 2007-298137 filed on 16 Nov. 2007, whose priority is claimed under 35 USC §119, and the disclosure of which is incorporated by reference in its entirety.

BACKGROUND OF THE INVENTION

1. Field of the Invention

The present invention relates to an electrophotographic photoreceptor containing an amine compound which can effectively prevent image defects due to oxidizing gases such as ozone and NOx, and an image forming apparatus including the photoreceptor.

2. Description of the Related Art

An image forming apparatus of an electrophotography system (hereinafter, also referred to as an "electrophotographic apparatus"), which forms images using an electrophotographic technology, is widely used in copying machines, printers, facsimile machines and the like.

In an electrophotographic apparatus, an image is formed through the following electrophotographic process. First, a photosensitive layer of an electrophotographic photoreceptor (hereinafter, also referred to as a "photoreceptor") included in the apparatus becomes charged, and then is exposed to form an electrostatic latent image. The formed electrostatic latent image is developed to form a toner image, and the formed toner image is transferred onto a transfer material such as recording paper and fixed to form a desired image on the transfer material.

In recent years, the electrophotographic technology is used not only in the field of a copying machine but also in the field of a printing plate material, a slide film, and a microfilm, in which a silver-salt photographic technology has been conventionally used. For example, the electrophotographic technology is applied to a high-speed printer which uses laser, a light emitting diode (LED), or a cathode ray tube (CRT) as a light source. As an application range of such an electrophotographic technology expands, requirements for the photoreceptor are becoming sophisticated and wide.

As a photoreceptor, conventionally, inorganic photoreceptors comprising a photosensitive layer containing an inorganic photoconductive material such as selenium, zinc oxide or cadmium sulfide as a principal component are widely used.

The inorganic photoreceptor has a basic characteristic as a photoreceptor to some extent, but it has disadvantages that it is difficult to form a photosensitive layer, and plasticity is low and production cost is high. Furthermore, the inorganic photoconductive material is generally highly toxic and there is a large constraint to produce and handle the material.

As described above, since the inorganic photoconductive material and the inorganic photoreceptor using the inorganic photoconductive material have many drawbacks, research and development of an organic photoconductive material is being advanced.

In recent years, the organic photoconductive material is widely researched and developed, and not only it is applied to an electrostatic recording device such as a photoreceptor, but also it is beginning to be applied to a sensor element, an organic electroluminescent (EL) device and the like.

An organic photoreceptor using the organic photoconductive material has advantages that a film forming property of the photosensitive layer is good, plasticity is high, and the photoreceptor is lightweight and highly transparent, and a photoreceptor, which exhibits good sensitivity for a wide-range wavelength region by an appropriate sensitizing method, can be easily designed, and therefore its development is becoming the mainstream.

The organic photoreceptor originally had defects in sensitivity and durability, but these defects are outstandingly improved by development of a function separated type photoreceptor in which a charge generation function and a charge transport function are separated and different substances assume these functions separately. Furthermore, this layered photoreceptor also has advantages that a scope of selection of materials composing the photosensitive layer is wide and a photoreceptor having an arbitrary characteristic can be relatively easily prepared in addition to the aforementioned advantages which the organic photoreceptor has.

As a constitution of such an organic photoreceptor, there can be mentioned various constitutions such as a single layer structure formed by dispersing both a charge generating material and a charge transporting material (also referred to as a "charge transfer substance") in a binder resin on a substrate, a layered structure in which a charge generation layer formed by dispersing a charge generating material in a binder resin and a charge transporting layer formed by dispersing a charge transporting material in a binder resin are formed on a substrate in this order or in an inverse order, and an inversely layered structure of two layers. Among photoreceptors of these structures, a layered photoreceptor formed by stacking the charge transporting layer on the charge generation layer as a photosensitive layer is widely put to practical use since it has an excellent electrophotographic characteristic and high durability and it enables to design various photoreceptor characteristics because of a high degree of flexibility in material selection.

As a charge generating material used in these function separated type photoreceptors, a variety of substances such as a phthalocyanine pigment, a squarylium dye, an azo pigment, a perylene pigment, a polycyclic quinone pigment, a cyanin dye, a squaric acid dye and a pyrylium salt dye are investigated, and various materials having high lightfastness and a high charge generation capability are proposed.

Further, as the charge transporting material, various compounds such as a pyrazoline compound, a hydrazone compound, a triphenylamine compound, a stilbene compound and an enamine compound are known.

In such a photoreceptor having constitutions proposed or studied as above, various properties such as speeding up, durability and stability of sensitivity is required. Specifically, in response to recent electrophotographic apparatuses of a reversal development system such as digital copying machines and laser printers, it is required to achieve compatibility between the higher sensitivity responding to speeding up as a photoreceptor characteristic and the increase in durability (=longer life) by an improvement of wear resistance and stability of sensitivity. In addition to these, the photoreceptor to be used in a laser printer requires higher image reliability or repetition stability.

However, it is said that these photoreceptors generally have lower durability than inorganic photoreceptors as a large defect. The durability is broadly divided into durability in an aspect of physical properties of electrophotography such as sensitivity, a residual potential, a charging capability and image blurring, and mechanical durability against abrasion or flaw of the photoreceptor surface due to scrubbing. It is known that the primary cause of reduction in durability in an aspect of physical properties of electrophotography is ozone or NOx (nitrogen oxide) generated due to corona discharge or degradation of a charge transporting material contained in a surface layer of the photoreceptor due to light irradiation. Many charge transporting materials made of various structures proposed in large numbers are being improved in terms of durability, but it is not adequate from a practical viewpoint.

Further, a photoreceptor is repeatedly used in a system, and in such a situation, electrophotographic characteristics which are always constant and stable are required. As for such stability and durability, an adequate photoreceptor is not yet attained in any constituent.

That is, with repeated use, problems such as a reduction in potential, an increase in residual potential, and a change in sensitivity arise, the copy quality is deteriorated, and the photoreceptor becomes inoperative. The causes of these degradation is not fully explained, but some factors are conceivable.

For example, it is known that ozone emitted from a corona discharge charger, and oxidizing gases such as nitrogen oxide cause significant damages to the photosensitive layer. These oxidizing gases chemically change materials in the photosensitive layer to cause various changes of characteristics. For example, oxidizing gases cause reduction in a charging potential, an increase in a residual potential, and deterioration of a resolution power due to a decrease in surface resistance, and consequently image blurring such as white spots or black stripes is generated on an output image to deteriorate the image quality seriously and shorten the life of the photoreceptor. Against such phenomena, a proposal of taking countermeasures in which the gas around the corona charger is efficiently exhausted or replaced to avoid a direct effect of the gas on the photoreceptor, and a proposal of adding an antioxidant or a stabilizer to the photosensitive layer to prevent degradation are presented.

For example, in Japanese Unexamined Patent Publication No. 62-105151, it is disclosed to add an antioxidant having a triazine ring and a hindered phenol skeleton in a molecule to a photosensitive layer, and in Japanese Unexamined Patent Publication No. Sho 63 (1988)-18355, it is disclosed to add a specific hindered amine to a photosensitive layer. Further, in Japanese Unexamined Patent Publication No. Sho 63 (1988)-4238, Japanese Unexamined Patent Publication No. Sho 63 (1988)-216055 and Japanese Unexamined Patent Publication No. Hei 3 (1991)-172852, it is disclosed to add trialkylamine and aromatic amine to a photosensitive layer, and in Japanese Unexamined Patent Publication No. Hei 5 (1993)-158258, it is disclosed to add amine dimer to a photosensitive layer, but these methods are still inadequate.

That is, an adequate effect of ozone resistance is not yet achieved by such conventional techniques, and the current state of affairs is that a practically adverse effect that addition of such an antioxidant causes the deterioration of electrophotographic characteristics such as sensitivity and a residual potential still remains. Accordingly, a proposal of a novel material which improves ozone resistance and does not have an adverse effect on the electrophotographic characteristics at all is desired.

SUMMARY OF THE INVENTION

Therefore, it is an object of the present invention to provide a photoreceptor using a novel amine compound which has an excellent effect of ozone resistance, prevents the deterioration of a characteristic in repeated use and can be used for providing a photoreceptor having an extremely small adverse effect on other characteristics, and an image forming apparatus including the photoreceptor.

The present inventors made earnest efforts, and consequently they have found that an amine compound having a hindered phenol structure hardly causes the deterioration of an initial characteristic due to the addition of the amine compound and has an excellent effect of ozone resistance and effectively prevents the deterioration of a characteristic in repeated use, leading to completion of the present invention.

Thus, according to the present invention, there is provided an electrophotographic photoreceptor including a conductive substrate made of a conductive material and a photosensitive layer containing a charge generating material and a charge transporting material, provided on the conductive substrate, wherein the photosensitive layer contains an amine compound of a hindered phenol structure, having the following general formula (1) or (2):

(1)

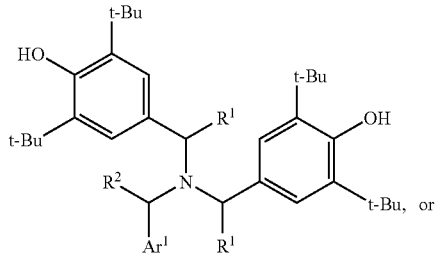

(2)

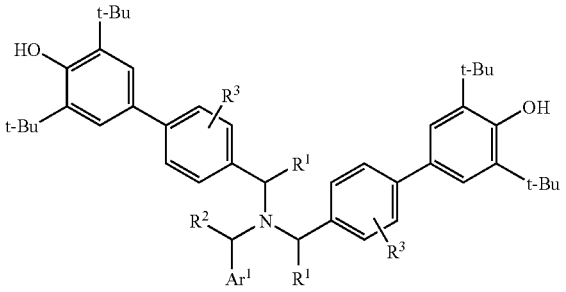

wherein $Ar^1$ represents an aryl group optionally having a substituent, a cycloalkyl group optionally having a substituent, a heteroatom-containing cycloalkyl group optionally having a substituent or a monovalent heterocyclic residue optionally having a substituent, each of $R^1$ and $R^2$ represents a hydrogen atom, an alkyl group optionally having a substituent or an aryl group optionally having a substituent, and $R^3$ represents a hydrogen atom, an alkyl group optionally having a substituent, an alkoxy group optionally having a substituent or a halogen atom, and t-Bu represents tert-butyl group.

Further, according to the present invention, there is provided an electrophotographic photoreceptor, in which the photosensitive layer is a layered photosensitive layer of a charge generation layer containing a charge generating material and a charge transporting layer containing a charge transporting material or a single layer type photosensitive layer containing a charge generating material and a charge transporting material.

Further, according to the present invention, there is provided the electrophotographic photoreceptor, in which a ratio A/B of a weight A of the charge transporting material to a weight B of the amine compound expressed by the general formula (1) or the general formula (2) is 100/0.1 or more and 100/20 or less in the photosensitive layer.

Further, according to the present invention, there is provided the electrophotographic photoreceptor, further having an intermediate layer between the conductive substrate and the photosensitive layer.

Further, according to the present invention, there is provided an image forming apparatus, including the photoreceptor, a charging means to charge the photoreceptor, exposing means to expose the photoreceptor charged, and developing means to develop an electrostatic latent image formed by exposure.

Further, according to the present invention, there is provided the image forming apparatus, in which the charging means is contact charging.

The amine compound having a hindered phenol structure of the present invention is suitable as a compound used in combination with an organic photoconductive material since it has excellent ozone resistance and antioxidant effects and has an extremely small detrimental effect on an electrophotographic characteristic by including the amine compound in a photosensitive layer containing the organic photoconductive material.

Accordingly, by including the amine compound according to the present invention in, for example, the photosensitive layer of the photoreceptor, it becomes possible to provide a photoreceptor having an effect of ozone resistance and simultaneously having excellent durability and environment stability.

Further, since the amine compound according to the present invention has a hindered phenol structure having a high antioxidant capability and a tribenzylamine structure having excellent ozone resistance in a molecule, it is not necessary to add both an antioxidant and an additive for resisting ozone, and since the amine compound has two or more hindered phenol structures in a molecule, the necessary amount to be added is small and therefore it hardly causes the deterioration of an initial characteristic due to the addition of the amine compound. Furthermore, since the amine compound according to the present invention does not have a sublimating property in contrast to BHT, it has prolonged stability.

Further, the photoreceptor of the present invention can provide images of high quality by virtue of its excellent ozone resistance and antioxidant effect even when it is used in a high-speed electrophotographic process.

Therefore, by using the photoreceptor according to the present invention, images of high quality can be formed even when the photoreceptor is repeatedly use over a prolonged period.

Further, the photoreceptor according to the present invention has an excellent effect of ozone resistance and is superior in a photoreceptor memory stoppage phenomenon associated with a longer life of the photoreceptor.

Accordingly, in an image forming apparatus according to the present invention, image defect-free images of high quality can be formed stably over a prolonged period in various environments.

Further, since the photoreceptor according to the present invention can provide images of high quality even in a high-speed electrophotographic process, in the image forming apparatus according to the present invention, it is possible to speed up a rate of image formation.

DETAILED DESCRIPTION OF THE PREFERRED EMBODIMENT

Figure 1:
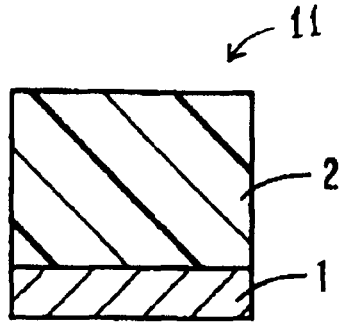
FIG. 1 is a schematic sectional view showing a constitution of a main part of a single layer type photoreceptor of the present invention.

A photoreceptor of the present invention is a photoreceptor formed by stacking a single layer type photosensitive layer containing a charge generating material and a charge transporting material, or a layered photosensitive layer, in which a charge generation layer containing a charge generating material and a charge transporting layer containing a charge transporting material are stacked in this order, on a conductive substrate made of a conductive material, wherein the single layer type photosensitive layer or the charge transporting layer of the layered photosensitive layer contains an amine compound expressed by the general formula (1) or (2):

(1)

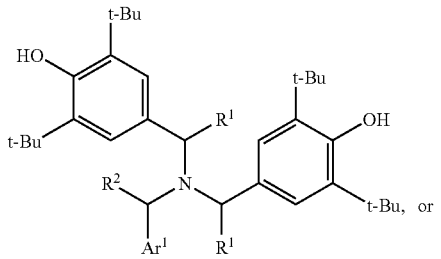

(2)

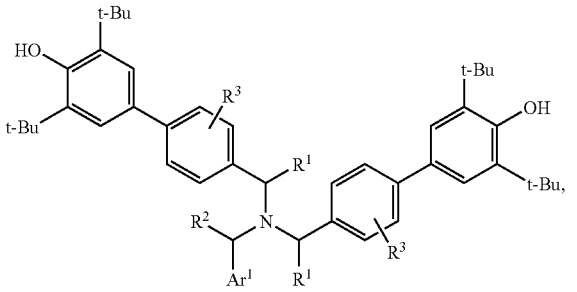

wherein $Ar^1$ represents an aryl group optionally having a substituent, a cycloalkyl group optionally having a substituent, a heteroatom-containing cycloalkyl group optionally having a substituent or a monovalent heterocyclic residue optionally having a substituent, each of $R^1$ and $R^2$ represents a hydrogen atom, an alkyl group optionally having a substituent or an aryl group optionally having a substituent, and $R^3$ represents a hydrogen atom, an alkyl group optionally having a substituent, an alkoxy group optionally having a substituent or a halogen atom.

The substituents in the general formula (1) and (2) will be described.

Examples of the aryl group optionally having a substituent denoted by $Ar^1$ include a phenyl group, a tolyl group, a xylyl group, a methoxyphenyl group, a methylmethoxyphenyl group, a t-butylphenyl group, a 4-diethylaminophenyl group, a 4-chlorophenyl group, a 4-fluorophenyl group, a 3,5-t-butyl-4-hydroxy-phenyl group, a naphthyl group, a methoxynaphthyl group, a tetrahydro-naphthanyl group, and a biphenyl group.

Examples of the cycloalkyl group optionally having a substituent denoted by $Ar^1$ include a cyclohexyl group, a cyclopentyl group, and a 4,4-dimethylcyclohexyl group.

Examples of the heteroatom-containing cycloalkyl group optionally having a substituent denoted by $Ar^1$ include a tetrahydrofuryl group, a tetrahydropyranyl group, a 1,3-dioxolyl group, and a tetramethyltetrahydrofuryl group.

Examples of the monovalent heterocyclic residue optionally having a substituent denoted by $Ar^1$ include a furyl group, a benzofuryl group, an isobenzofuryl group, a benzothiophenyl group, and a thianaphtyl group.

Examples of the alkyl group optionally having a substituent denoted by $R^1$ or $R^2$ include a methyl group, an ethyl group, an isopropyl group, an ester group and alkyl groups having 1 to 3 carbon atoms with which a carboxyl group is coupled.

Examples of the aryl group optionally having a substituent denoted by $R^1$ or $R^2$ include a phenyl group, a methoxyphenyl group, a 4-fluorophenyl group, and a biphenyl group.

Examples of the alkyl group optionally having a substituent denoted by $R^3$ include a methyl group, an ethyl group, a propyl group, an isopropyl group, and a trifluoromethyl group.

Examples of the alkoxy group optionally having a substituent denoted by $R^3$ include a methoxy group, an ethoxy group, and an isopropoxy group.

Examples of the halogen atom denoted by $R^3$ include a fluorine atom and a chlorine atom.

The amine compound expressed by the above general formulas (1) and (2) of the present invention can be produced as follows.

That is, by heating an amine compound expressed by the general formula (3):

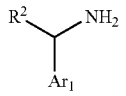

(3)

wherein $Ar^1$ and $R^2$ are as defined for the compounds of the above general formulas (1) and (2), and a bromo-compound expressed by the general formula (4) or (5);

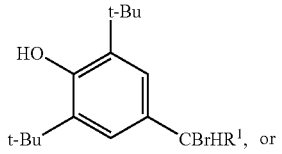

(4)

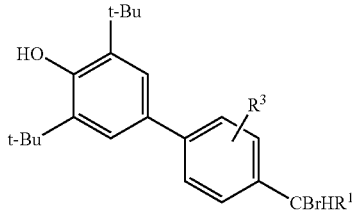

(5)

wherein $R^1$ and $R^3$ are as defined for the compounds of the above general formulas (1) and (2)

in the presence of an organic amine base, an objective compound of high purity can be simply produced in high yield.

This reaction can be performed, for example, in the following manner.

That is, compounds inactive with this reaction, in which a reaction substrate and an organic amine base can be dissolved or dispersed, such as aromatic hydrocarbons such as toluene and xylene, chain or cyclic ethers such as diethyl ether, tetrahydrofuran, ethylene glycol dimethyl ether and 1,4-dioxane, amides such as N,N-dimethylformamide, and sulfoxides such as dimethyl sulfoxide, are used singly as a solvent or used as a mixed solvent without particular constraint, the amine compound (3) and the bromo-compound (4) or (5) are added to this solvent, and to this, an organic amine base such as N,N-diisopropylethylamine, N,N-dimethylaminopyridine, or 1,4-diazabicycloundecene is added, and the resulting mixture is stirred while being heated. After the completion of a reaction, a precipitated substance is separated by filtration and is recrystallized in a solvent or a mixed solvent of ethanol, methanol and ethyl acetate, and thereby an objective compound of high purity can be simply obtained in high yield.

In addition, an amount of the solvent to be used is not particularly limited and can be appropriately selected in such a way that the reaction smoothly proceeds depending on reaction conditions such as an amount of the reaction substrate, a reaction temperature and a reaction time.

Here, the use proportion between the amine compound (3) and the bromo-compound (4) or (5) is not particularly limited, but about 2.05 to 2.3 equivalent weights of the bromo-compound is preferably used with respect to 1 equivalent weight of the amine compound (3) in consideration of reaction efficiency.

Furthermore, the use proportion between the amine compound (3) and the organic amine base is not particularly limited, but about 2.05 to 5.0 equivalent weights of the organic amine base is preferably used with respect to 1 equivalent weight of the amine compound (3) in consideration of reaction efficiency.

Further, a heating temperature and a reaction time are not particularly limited, however, depending on a solvent to be used, the reaction is preferably performed at a temperature of 60 to 120° C. for 2 to 8 hours in consideration of reaction efficiency.

Specific examples of the amine compound of the present invention expressed by the general formulas (1) and (2), thus obtained, are listed in Table 1 below.

TABLE 1
| Exemplary Compound | Structural Formula |
|---|---|
| Exemplary Compound 1 | 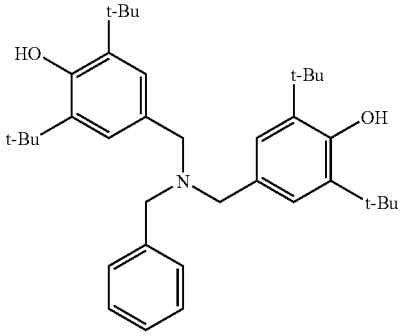 |
| Exemplary Compound 2 | 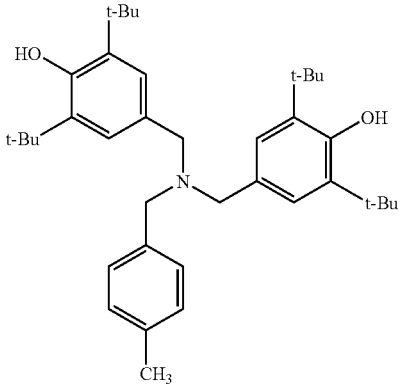 |
| Exemplary Compound 3 | 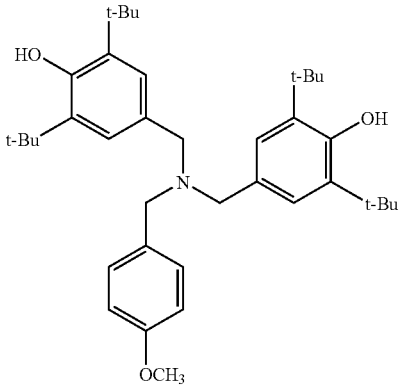 |
| Exemplary Compound 4 | 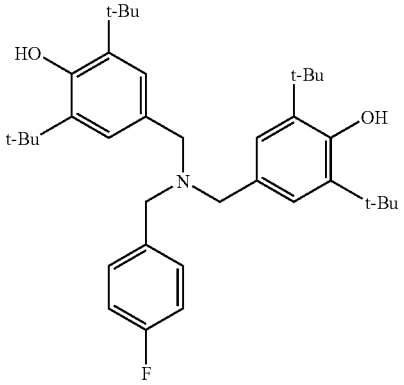 |

TABLE 1-continued
| Exemplary Compound | Structural Formula |
|---|---|
| Exemplary Compound 5 | 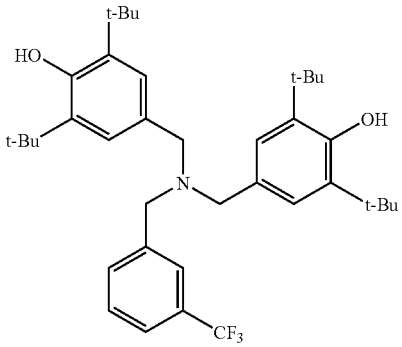 |
| Exemplary Compound 6 | 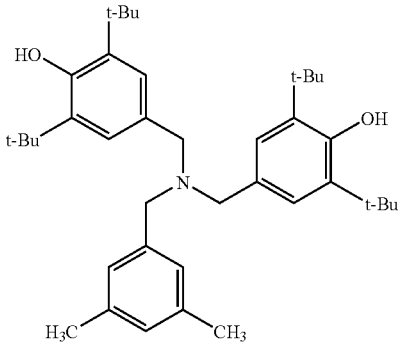 |
| Exemplary Compound 7 | 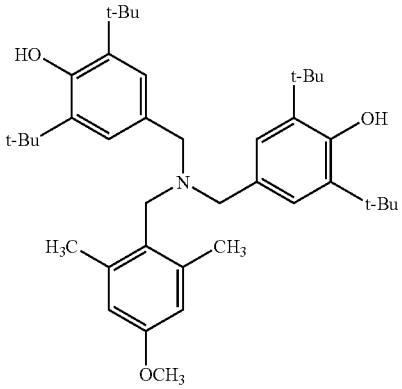 |
| Exemplary Compound 8 | 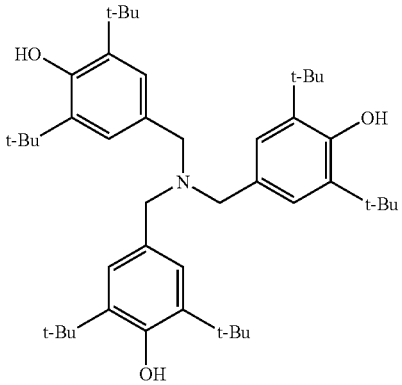 |

TABLE 1-continued
| Exemplary Compound | Structural Formula |
|---|---|
| Exemplary Compound 9 | 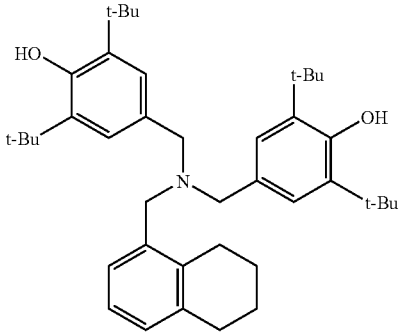 |
| Exemplary Compound 10 | 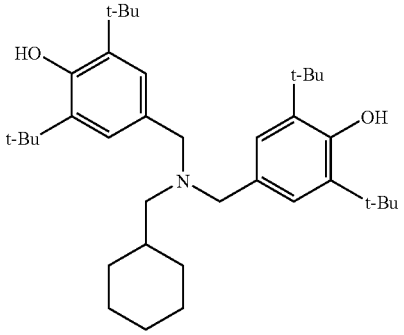 |
| Exemplary Compound 11 | 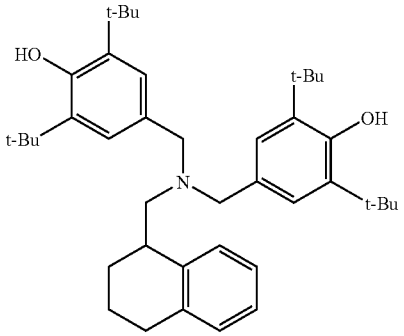 |
| Exemplary Compound 12 | 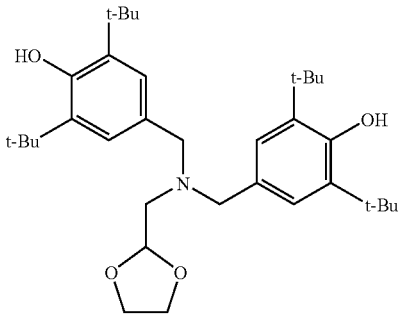 |

TABLE 1-continued
| Exemplary Compound | Structural Formula |
|---|---|
| Exemplary Compound 13 | 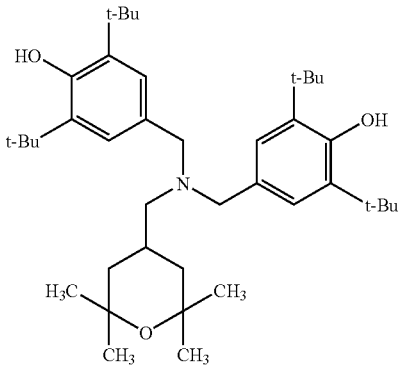 |
| Exemplary Compound 14 | 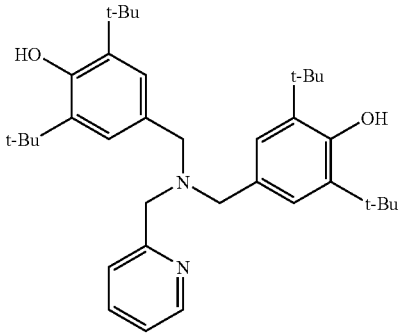 |
| Exemplary Compound 15 | 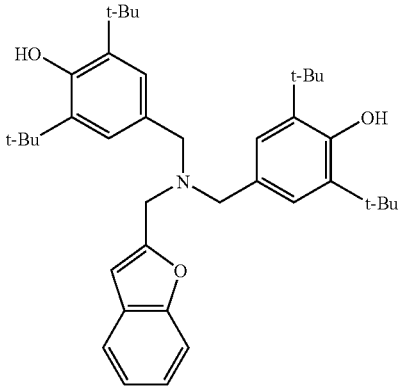 |
| Exemplary Compound 16 | 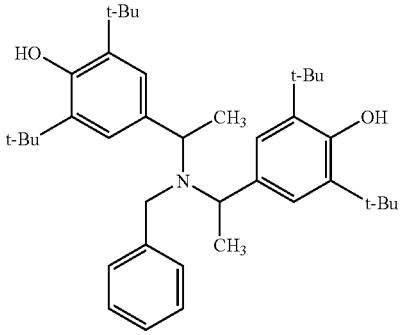 |

TABLE 1-continued
| Exemplary Compound | Structural Formula |
|---|---|
| Exemplary Compound 17 | 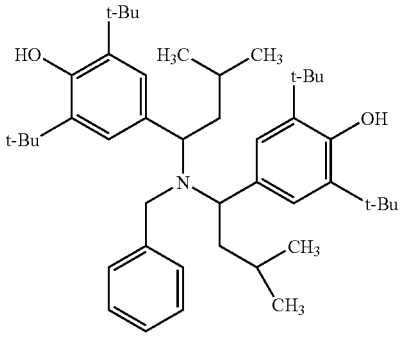 |
| Exemplary Compound 18 | 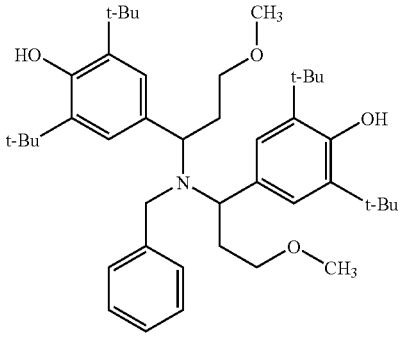 |
| Exemplary Compound 19 | 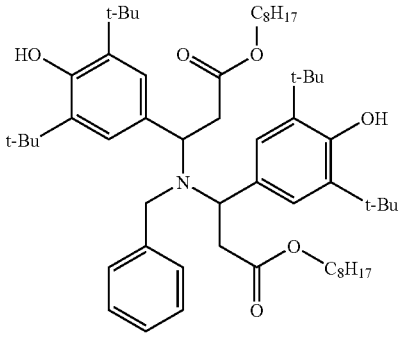 |
| Exemplary Compound 20 | 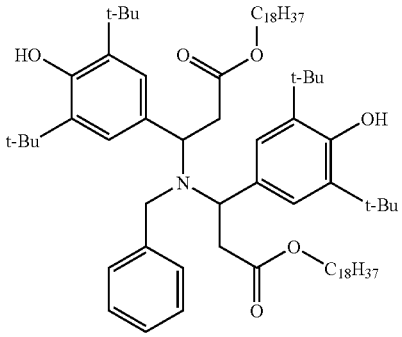 |

TABLE 1-continued
| Exemplary Compound | Structural Formula |
|---|---|
| Exemplary Compound 21 | 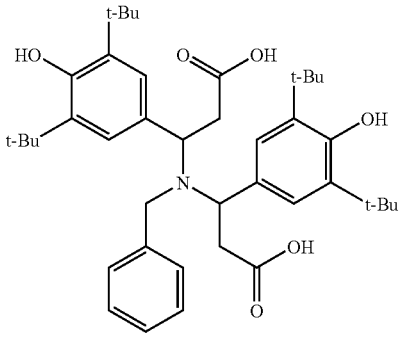 |
| Exemplary Compound 22 | 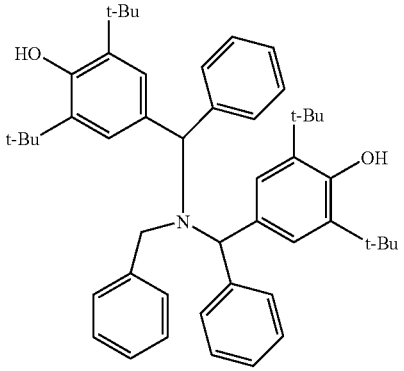 |
| Exemplary Compound 23 | 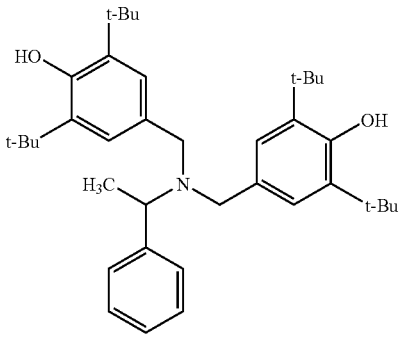 |
| Exemplary Compound 24 | 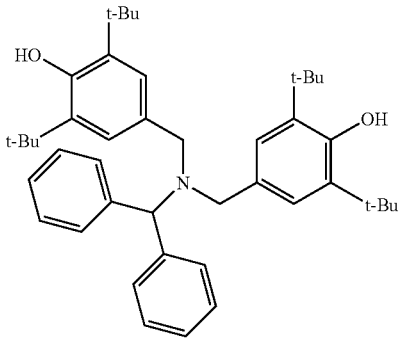 |

TABLE 1-continued
| Exemplary Compound | Structural Formula |
|---|---|
| Exemplary Compound 25 | 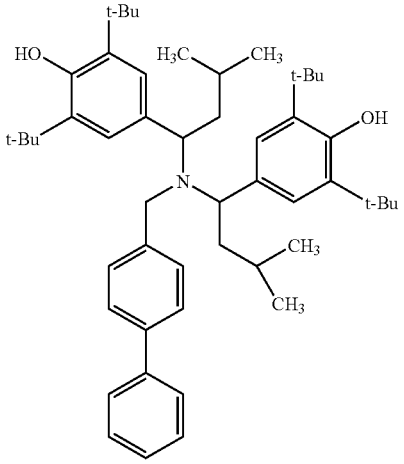 |
| Exemplary Compound 26 | 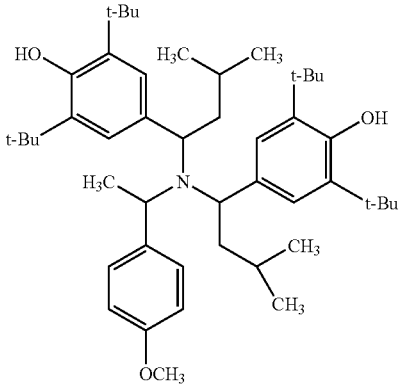 |
| Exemplary Compound 27 | 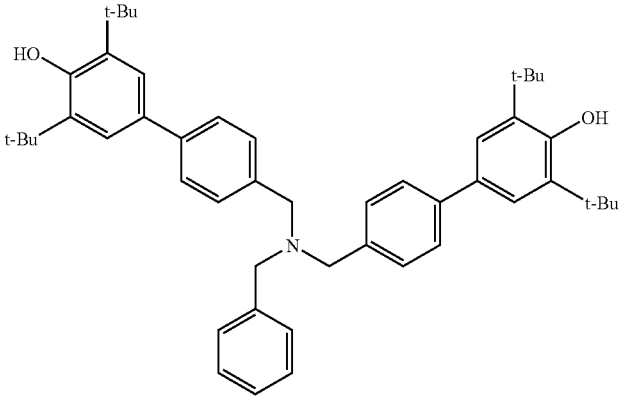 |

TABLE 1-continued
| Exemplary Compound | Structural Formula |
|---|---|
| Exemplary Compound 28 | 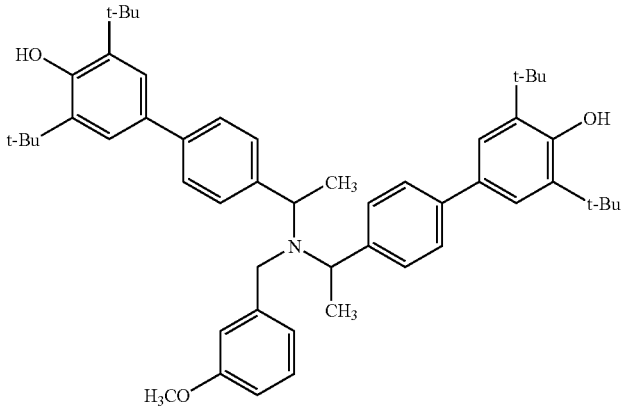 |
| Exemplary Compound 29 | 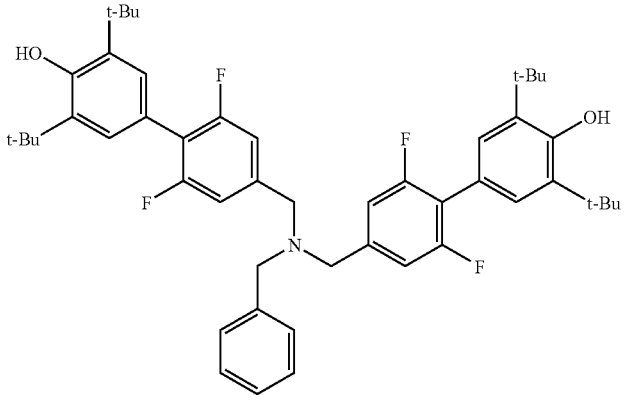 |
| Exemplary Compound 30 | 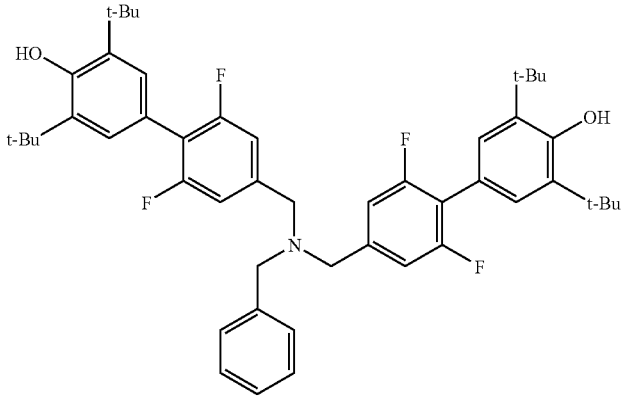 |

TABLE 1-continued
| Exemplary Compound | Structural Formula |
|---|---|
| Exemplary Compound 31 | 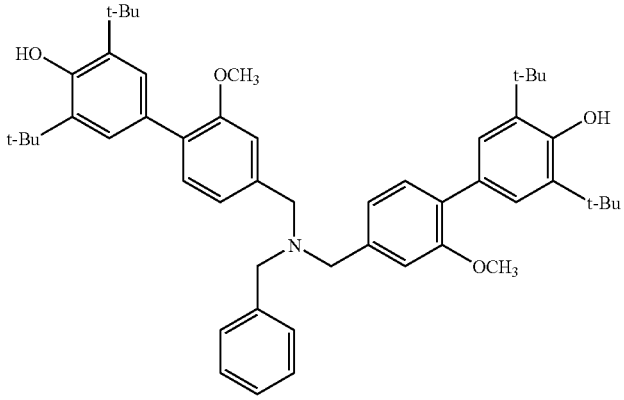 |
| Exemplary Compound 32 | 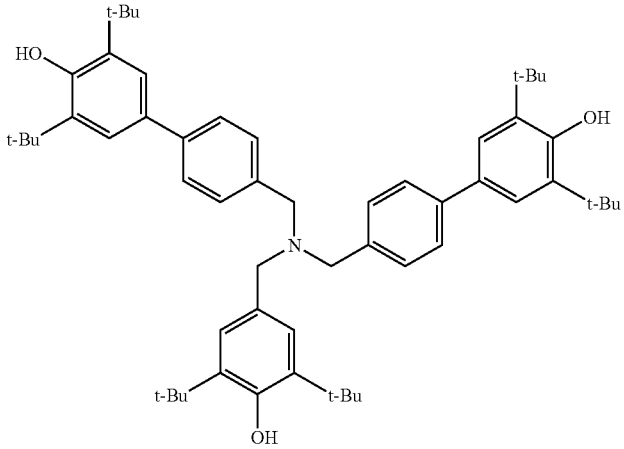 |
| Exemplary Compound 33 | 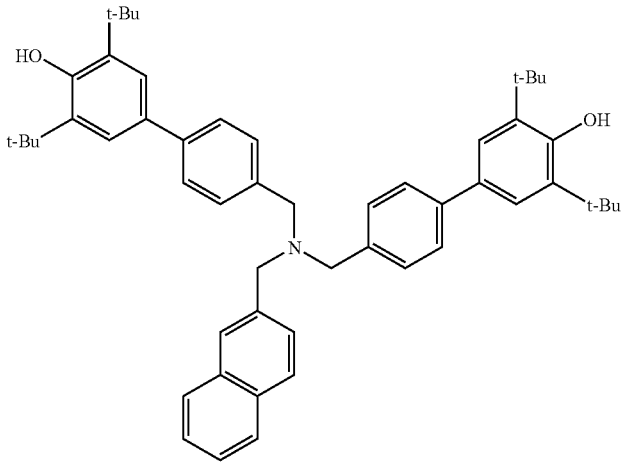 |

TABLE 1-continued

| Exemplary Compound | Structural Formula |
|---|---|
| Exemplary Compound 34 | 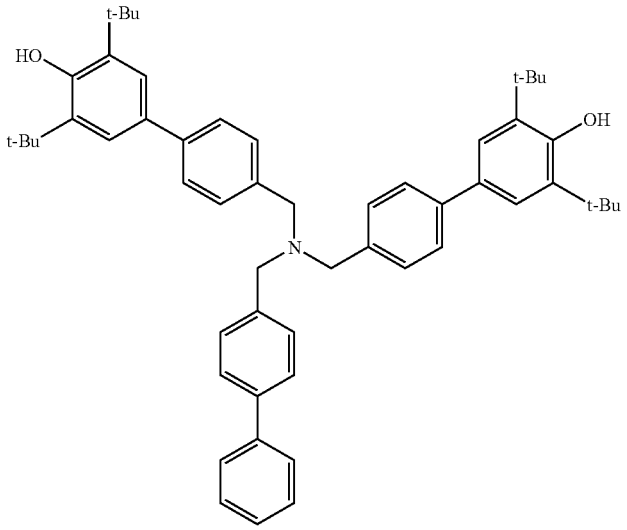 |
| Exemplary Compound 35 | 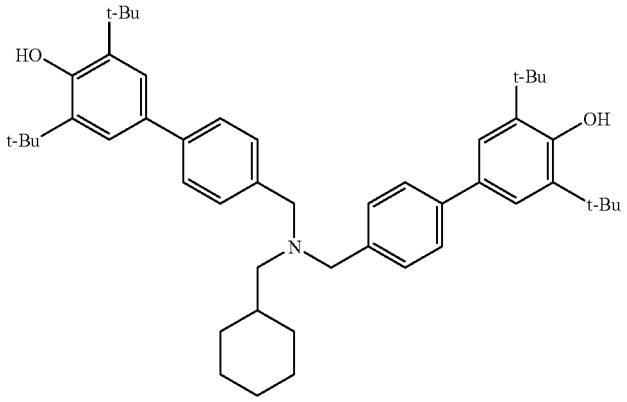 |

Among the aforementioned compounds, exemplary compound Nos. 1, 2, 8, 19, 21 and 28 are preferable in that these compounds have adequate characteristics and antioxidants from a low cost industrial material can be used as raw materials of these compounds, and the exemplary compound No. 1 is particularly preferable.

Next, a constitution of the photoreceptor of the present invention will be specifically described.

FIGS. 1 to 8 are schematic sectional views showing a constitution of an main part of the photoreceptor of the present invention.

FIGS. 1 to 4 are schematic sectional views showing a constitution of a main part of the single layer type photoreceptor of which a photosensitive layer is the single layer type photosensitive layer composed of one layer.

Further, FIGS. 5 to 8 are schematic sectional views showing a constitution of a main part of the layered photoreceptor (hereinafter, also referred to as a "function separated type photoreceptor") of which a photosensitive layer is the layered photosensitive layer consisting of the charge generation layer and the charge transporting layer (hereinafter, also referred to as a "function separated type photosensitive layer"). The photoreceptor of the present invention may take on an inversely layered structure of two layers in which the charge generation layer and the charge transporting layer are stacked in an inverse order to form a photoreceptor, but the aforementioned layered photoreceptor is preferable.

In a photoreceptor 11 in FIG. 1, a single layer type photosensitive layer 2 is formed on a surface of a conductive substrate 1.

Figure 2:
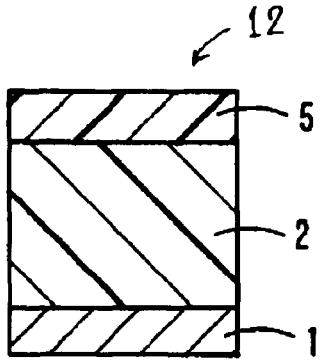
FIG. 2 is a schematic sectional view showing a constitution of a main part of the single layer type photoreceptor of the present invention.

In a photoreceptor 12 in FIG. 2, the single layer type photosensitive layer 2 and a surface protective layer 5 are formed in this order on a surface of the conductive substrate 1.

Figure 3:
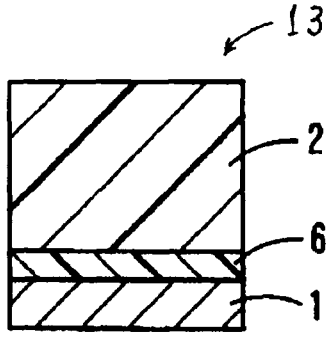
FIG. 3 is a schematic sectional view showing a constitution of a main part of the single layer type photoreceptor of the present invention.

In a photoreceptor 13 in FIG. 3, an intermediate layer 6 and the single layer type photosensitive layer 2 are formed in this order on a surface of the conductive substrate 1.

Figure 4:
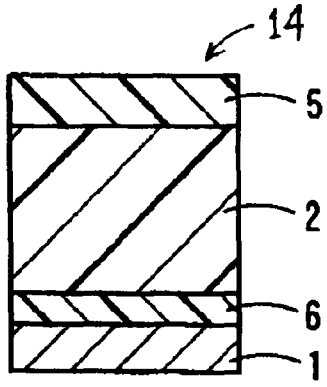
FIG. 4 is a schematic sectional view showing a constitution of a main part of the single layer type photoreceptor of the present invention.

In a photoreceptor 14 in FIG. 4, the intermediate layer 6, the single layer type photosensitive layer 2 and the surface protective layer 5 are formed in this order on a surface of the conductive substrate 1.

Figure 5:
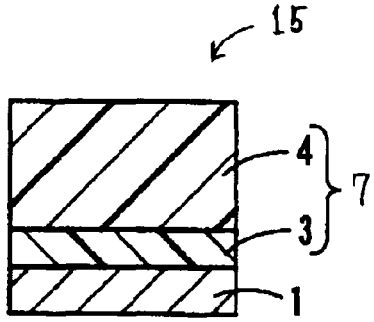
FIG. 5 is a schematic sectional view showing a constitution of a main part of a layered photoreceptor of the present invention.

In a photoreceptor 15 in FIG. 5, a layered photosensitive layer 7 formed by stacking a charge generation layer 3 and a charge transporting layer 4 in this order is formed on a surface of the conductive substrate 1.

Figure 6:
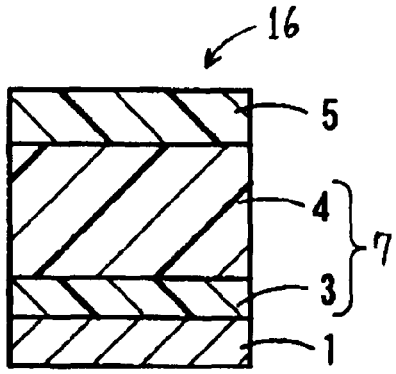
FIG. 6 is a schematic sectional view showing a constitution of a main part of the layered photoreceptor of the present invention.

In a photoreceptor 16 in FIG. 6, the layered photosensitive layer 7 formed by stacking the charge generation layer 3 and the charge transporting layer 4 in this order, and the surface protective layer 5 are formed in this order on a surface of the conductive substrate 1.

Figure 7:
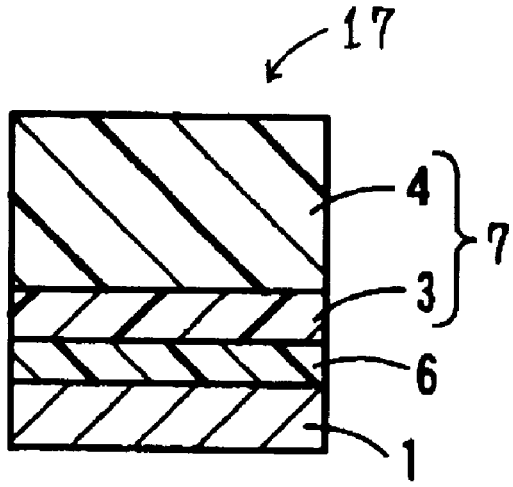
FIG. 7 is a schematic sectional view showing a constitution of a main part of the layered photoreceptor of the present invention.

In a photoreceptor 17 in FIG. 7, the intermediate layer 6 and the layered photosensitive layer 7 formed by stacking the charge generation layer 3 and the charge transporting layer 4 in this order are formed in this order on a surface of the conductive substrate 1.

Figure 8:
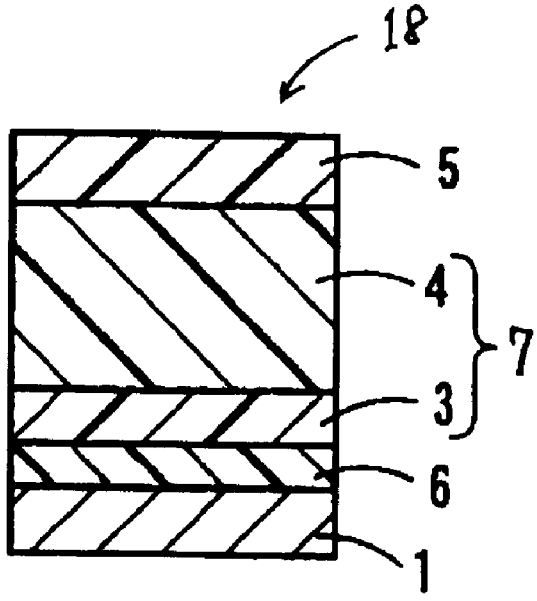
FIG. 8 is a schematic sectional view showing a constitution of a main part of the layered photoreceptor of the present invention.

In a photoreceptor 18 in FIG. 8, the intermediate layer 6, the layered photosensitive layer 7 formed by stacking the charge generation layer 3 and the charge transporting layer 4 in this order, and the surface protective layer 5 are formed in this order on a surface of the conductive substrate 1.

[Conductive Substrate 1 (Raw Tube for Photoreceptor)]

A constituent material of the conductive substrate is not particularly limited as long as it is a material used in this field.

Specific examples of the constituent material of the conductive substrate include metal materials such as aluminum, aluminum alloys, copper, zinc, stainless steel, and titanium; polymer materials such as polyethylene terephthalate, polyamide, polyester, polyoxymethylene, and polystyrene; substances formed by laminating metal foil on the surface of the substrate made of hard paper, glass or the like; substances formed by depositing a metal material by vapor deposition on the surface of the substrate; substances formed by depositing by vapor deposition or applying a layer of a conductive compound such as a conductive polymer, tin oxide, or indium oxide on the surface of the substrate.

The shape of the conductive substrate is not limited to a sheet form shown in FIGS. 1 to 8, and it may be a cylindrical shape, a cylindrical column shape, or a shape of an endless belt.

An anodic oxide film treatment, a surface treatment with chemicals or hot water, a coloring treatment, or a diffuse reflection treatment such as surface roughening may be applied to the surface of the conductive substrate 1 within the limits of not affecting image quality as required.

The diffuse reflection treatment is particularly effective when the photoreceptor according to the present invention is used in an electrophotographic process using laser as an exposure source. That is, in an electrophotographic process in which laser is used as an exposure source, since wavelengths of laser light are uniform, there may be cases where interference occurs between laser light reflected off the photoreceptor surface and laser light reflected within the photoreceptor, and interference fringes due to this interference appear on the image to cause image defects. Therefore, by subjecting the surface of the conductive substrate to the diffuse reflection treatment, image defects due to the interference of laser light having uniform wavelengths can be prevented.

[Single Layer Type Photosensitive Layer 2]

The single layer type photosensitive layer contains the charge generating material, the charge transporting material, the amine compound of the present invention, and the binder resin.

The charge generating material has a capability of generating a charge by absorbing light.

As the charge generating material, compounds used in this field can be used. Specific examples of the charge generating material include organic pigments or dyes such as azo pigments (monoazo pigments, bisazo pigments, trisazo pigments and the like), indigo pigments (indigo, thioindigo and the like), perylene pigments (peryleneimide, perylene acid anhydride and the like), polycyclic quinone pigments (anthraquinone, pyrenequinone and the like), phthalocyanine pigments (metal phthalocyanine, X type non-metal phthalocyanine and the like), a squarylium dye, pyrylium salts, thiopyrylium salts and triphenylmethane dyes, and inorganic materials such as selenium and amorphous silicon. These charge generating materials may be used singly, or may be used in combination of two or more species.

Among these charge generating materials, phthalocyanine pigments such as metal phthalocyanine and X type non-metal phthalocyanine are preferable, and oxotitanium phthalocyanine is particularly preferable.

Since the phthalocyanine pigments have high charge generation efficiency and high charge injection efficiency, a large amount of charges are generated by absorbing light, and the generated charges can be efficiently injected into and smoothly transported to the charge transporting material contained in the single layer type photosensitive layer without being accumulated within a molecule, and therefore a highly sensitive and high-resolution photoreceptor can be attained. This effect is similarly attained in a layered photoreceptor described later.

The charge generating material can be used in combination with a sensitizing dye.

Examples of such a sensitizing dye include triphenylmethane dyes typified by methyl violet, crystal violet, night blue and victoria blue; acridine dyes typified by Erythrocin, rhodamine B, rhodamine 3R, acridine orange and frapeosine; thiazine dyes typified by methylene blue and methylene green; oxazine dyes typified by capri blue and meldola blue; cyanine dyes; styryl dyes; pyrylium salt dyes, and thiopyrylium salt dyes.

The charge transporting material has a capability of receiving and transporting a charge generated in the charge generating material, and includes a hole transport substance and an electron transport substance.

As the hole transport substance, compounds used in this field can be used.

Specific examples of the hole transport substance include carbazole derivatives, pyrene derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives, enamine derivatives, and benzidine derivatives, and polymers having a group derived from these compounds on the main chain or the side chain (poly(N-vinylcarbazole), poly(1-vinylpyrene), an ethylcarbazole-formaldehyde resin, a triphenylmethane polymer and poly(9-vinylanthracene)).

As the charge transporting material, compounds used in this field can be used.

Specific examples of the charge transporting material include benzoquinone derivatives, tetracyanoethylene derivatives, tetracyanoquinodimethane derivatives, fluorenone derivatives, xanthone derivatives, phenanthraquinone derivatives, phthalic anhydride derivatives, and diphenoquinone derivatives. These charge transporting materials may be used singly, or may be used in combination of two or more species.

As the binder resin, for example, a resin having an adhesive property, which is used for the purpose of improving mechanical strength and durability of the single layer type photosensitive layer and used in this field, can be used, and a resin having excellent compatibility with the amine compound of the present invention is preferable.

Specific examples of the binder resin include vinyl resins such as a polymethyl methacrylate, polystyrene, and polyvinyl chloride; thermoplastic resins such as polycarbonate, polyester, polyestercarbonate, polysulfone, polyallylate, polyamide, a methacrylic resin, an acrylic resin, polyether, polyacrylamide, and polyphenylene oxide; thermosetting resins such as a phenoxy resin, an epoxy resin, a silicone resin, polyurethane, a phenolic resin, an alkyd resin, a melamine resin, a phenoxy resin, polyvinyl butyral, and polyvinyl formal; partially crosslinked products of these resins; and copolymer resins containing two or more of constituent units contained in these resins (insulating resins such as a vinyl chloride-vinyl acetate copolymer resin, a vinyl chloride-vinyl acetate-maleic anhydride copolymer resin, and an acrylonitrile-styrene copolymer resin). These binder resins may be used singly, or may be used in combination of two or more species.

Among these resins, polystyrene, polycarbonate, polyallylate and polyphenylene oxide are preferable because they are particularly superior in compatibility with the amine compound of the present invention, and have a volume resistance of $10^{13}\Omega$ or more and are superior in electrical insulating properties, and have an excellent film forming property and excellent electric potential characteristics, and polycarbonate can be particularly suitably used.

The use proportion between the charge transporting material and the amine compound of the present invention is not particularly limited, but when a weight of the charge transporting material is denoted by A and a weight of the amine compound is denoted by B, a ratio A/B between them is preferably 100/0.1 or more and 100/20 or less.

If an amount of the amine compound of the present invention to be used with respect to 100 parts by weight of the charge transporting material is less than 0.1 parts by weight, an effect of addition may be extremely small.

On the other hand, if an amount of the amine compound of the present invention to be used with respect to 100 parts by weight of the charge transporting material is more than 20 parts by weight, a relative ratio of the amount of the amine compound to the charge transporting material becomes large and therefore a phenomenon that sensitivity of the photoreceptor is deteriorated may be caused.

Further, the single layer type photosensitive layer may contain other additives such as an antioxidant used in this field. Such an additive is preferable since it enhances the stability of a coating solution for forming the photosensitive layer to prolong a life of the coating solution and reduces oxidizing impurities in the photoreceptor produced from the coating solution to improve the durability of the photoreceptor.

Examples of the antioxidant include hindered phenol derivatives and hindered amine derivatives.

The use proportion between the charge transporting material and the antioxidant to be used in combination is not particularly limited, but 0.1 to 10 parts by weight of the antioxidant is preferable with respect to 100 parts by weight of the charge transporting material. When an amount of the antioxidant to be used is less than 0.1 parts by weight, an effect of improving the stability of a coating solution for forming the photosensitive layer and the durability of the photoreceptor described later may become inadequate, and when the amount of the antioxidant is more than 10 parts by weight, electric characteristics of the photoreceptor may be adversely affected.

The use proportion between the amine compound of the present invention, the charge generating material, the charge transporting material, the additive added as required and the binder resin is not particularly limited, but the content of the binder resin is preferably about 55 to 70% by weight of the total amount of these substances.

When the content of the binder resin is less than 55% by weight, film strength of the single layer type photosensitive layer may be decreased, and by contraries when the content of the binder resin is more than 70% by weight, a function of the single layer type photosensitive layer may be deteriorated. However, when a surface protective layer is formed, it is possible to reduce the content of the binder resin to less than 55% by weight.

The single layer type photosensitive layer 2 can be formed by dissolving or dispersing the amine compound of the present invention, the charge generating material, the charge transporting material and the binder resin, and the additive such as an antioxidant as required in an appropriate organic solvent to prepare a coating solution for forming the photosensitive layer, applying this coating solution onto the surface of the conductive substrate 1 or onto the surface of the intermediate layer 6 formed on the conductive substrate 1, and then drying the coating solution to eliminate the organic solvent. More specifically, a coating solution for forming the single layer type photosensitive layer is prepared by, for example, dissolving or dispersing a constituent material in a resin solution formed by dissolving the binder resin in an organic solvent.

Examples of the organic solvent include aromatic hydrocarbons such as benzene, toluene, xylene, mesitylene, tetralin, diphenylmethane, dimethoxybenzene, and dichlorobenzene; halogenated hydrocarbons such as dichloromethane, dichloroethane, and tetrachloropropane; ethers such as tetrahydrofuran (THF), dioxane, dibenzylether, dimethoxymethylether, and 1,2-dimethoxyethane; ketones such as methyl ethyl ketone, cyclohexanone, acetophenon, and isophorone; esters such as methyl benzoate, ethyl acetate, and butyl acetate; sulfur-containing solvents such as diphenylsulfide; fluorine solvents such as hexafluoroisopropanol; and aprotic polar solvents such as N,N-dimethylformamide and N,N-dimethylacetoamide. These solvents may be used singly, or may be used as a mixed solvent of them. Further, a mixed solvent formed by adding alcohols, acetonitrile or methyl ethyl ketone to the above solvent can also be used.

The charge generating material and other additives may be pre-ground prior to dissolving or dispersing of a constituent material in the resin solution.

Pre-grinding can be performed by using a common mill such as a ball mill, a sand mill, an Attritor, a vibrating mill or an ultrasonic dispersion machine.

Dissolving or dispersing of the constituent material in the resin solution can be performed by use of a common dispersion machine such as a paint shaker, a ball mill or a sand mill. At this time, preferably, dispersion conditions are appropriately set so as to prevent impurities from being generated from members constituting a container or a dispersion machine due to abrasion to be mixed in the coating solution.

Examples of a method of applying the coating solution for forming the single layer type photosensitive layer include a roller coating method, a spray coating method, a blade coating method, a ring coating method and a dip coating method.

A film thickness of the single layer type photosensitive layer is not particularly limited, but it is preferably 5 μm to 100 μm, and particularly preferably 10 μm to 50 μm. When the film thickness of the single layer type photosensitive layer is less than 5 μm, the charge retention capability of the surface of the photoreceptor may be deteriorated, and by contraries, when the film thickness of the single layer type photosensitive layer is more than 100 μm, productivity of the photoreceptor may be deteriorated.

[Layered Photosensitive Layer 7]

The layered photosensitive layer consists of the charge generation layer 3 and the charge transporting layer 4.

[Charge Generation Layer 3]

The charge generation layer 3 contains the charge generating material and the binder resin.

As the charge generating material, one or more species of the same charge generating materials as those contained in the single layer type photosensitive layer can be used.

As the binder resin, one or more species of the same binder resins as those contained in the single layer type photosensitive layer can be used.

The use proportion between the charge generating material and the binder resin is not particularly limited, but the content of the charge generating material in the total amount of the charge generating material and the binder resin is preferably 10 to 99% by weight and the rest is the binder resin.

When the content of the charge generating material is less than 10% by weight, sensitivity of the photoreceptor may be deteriorated, and by contraries when the content of the charge generating material is more than 99% by weight, there is a possibility that not only film strength of the charge generation layer is decreased, but also the dispersibility of the charge generating material is deteriorated to increase the number of the coarse particles, surface charges other than those in an area to be erased by exposure are decreased, and therefore image defects, particularly the fog of image referred to as a black spot, in which toner adheres to a white background to form minute black points, occur more frequently.

The charge generation layer may contain a proper amount of one or more species selected from a hole transport material, an electron transport material, an antioxidant, a dispersion stabilizer, and a sensitizer as required in addition to the aforementioned two species of essential components. Thereby, a voltage characteristic is improved, the stability of a coating solution for forming the charge generation layer described later is enhanced, and the fatigue degradation of the photoreceptor in repeated use can be mitigated and the durability of the photoreceptor can be improved.

The charge generation layer 3 can be formed by dissolving or dispersing the charge generating material, the binder resin, and another additive as required in an appropriate organic solvent to prepare a coating solution for forming the charge generation layer, applying this coating solution onto the surface of the conductive substrate 1 or onto the surface of the intermediate layer 6 formed on the conductive substrate 1, and then drying the coating solution to eliminate the organic solvent. More specifically, a coating solution for forming the charge generation layer is prepared, for example, by dissolving or dispersing of the charge generating material, and another additive as required in a resin solution formed by dissolving the binder resin in an organic solvent.

Other process steps and conditions thereof are similar to those of the single layer type photosensitive layer.

As the organic solvent, one or more species of the same solvents as those used for preparing a coating solution for forming the single layer type photosensitive layer can be used.

A film thickness of the charge generation layer 3 is not particularly limited, but it is preferably 0.05 μm to 5 μm, and particularly preferably 0.1 μm to 1 μm. When the film thickness of the charge generation layer is less than 0.05 μm, efficiency of light absorption is lowered and the sensitivity of the photoreceptor may be deteriorated, and by contraries, when the film thickness of the charge generation layer is more than 5 μm, charge transport within the charge generation layer comes into a rate-determining step of a process of erasing a charge at the surface of the photoreceptor, and the sensitivity of the photoreceptor may be deteriorated.

[Charge Transporting Layer 4]

The charge transporting layer 4 contains the charge transporting material, the amine compound of the present invention, and the binder resin.

As the amine compound of the present invention, one or more species of the same amine compounds as those contained in the single layer type photosensitive layer can be used.

As the charge transporting material, one or more species of the same charge transporting materials as those contained in the single layer type photosensitive layer can be used.

As the binder resin, one or more species of the same binder resins as those contained in the single layer type photosensitive layer can be used.

The use proportion between the charge transporting material and the amine compound of the present invention is similar to that of the single layer type photosensitive layer.

The use proportion between the charge transporting material and the binder resin is similar to that of the single layer type photosensitive layer.

The charge transporting layer may contain the same additives such as the antioxidant as those contained in the single layer type photosensitive layer as required in addition to the aforementioned three species of essential components.

The charge transporting layer 4 can be formed by dissolving or dispersing the charge transporting material, the amine compound of the present invention, the binder resin, and another additive as required in an appropriate organic solvent to prepare a coating solution for forming the charge transporting layer, applying this coating solution onto the surface of the charge generation layer 3, and then drying the coating solution to eliminate the organic solvent. More specifically, a coating solution for forming the charge transporting layer is prepared, for example, by dissolving or dispersing of the charge transporting material, the amine compound of the present invention, and another additive as required in a resin solution formed by dissolving the binder resin in an organic solvent.

Other process steps and conditions thereof are similar to those of the single layer type photosensitive layer.

A film thickness of the charge transporting layer 4 is not particularly limited, but it is preferably 5 μm to 50 μm, and particularly preferably 10 μm to 40 μm. When the film thickness of the charge transporting layer is less than 5 μm, the charge retention capability of the surface of the photoreceptor may be deteriorated, and by contraries, when the film thickness of the charge transporting layer is more than 50 μm, the resolution of the photoreceptor may be deteriorated.

[Surface Protective Layer 5]

The surface protective layer 5 has a function of improving durability of the photoreceptor and contains the charge transporting material and the binder resin.

As the charge transporting material, one or more species of the same charge transporting materials as those contained in the single layer type photosensitive layer can be used.

As the binder resin, one or more species of the same binder resins as those contained in the single layer type photosensitive layer can be used.

The surface protective layer 5 can be formed, for example, by dissolving or dispersing the charge transporting material and the binder resin in an appropriate organic solvent to prepare a coating solution for forming the surface protective layer, applying this coating solution for forming the surface protective layer onto the surface of the single layer type photosensitive layer 2 or the layered photosensitive layer 7, and eliminating the organic solvent by drying. As the organic solvent used here, the same solvent as that used for forming the photosensitive layer 2 can be used.

Other process steps and conditions thereof are similar to those of the single layer type photosensitive layer.

As the organic solvent, one or more species of the same solvents as those used for preparing a coating solution for forming the single layer type photosensitive layer can be used.

A film thickness of the surface protective layer 5 is not particularly limited, but it is preferably 0.5 μm to 10 μm, and particularly preferably 1 μm to 5 μm. When the film thickness of the surface protective layer 5 is less than 0.5 μm, abrasion resistance of the surface of the photoreceptor may be deteriorated and durability may become inadequate, and by contraries, when the film thickness of the surface protective layer 5 is more than 10 μm, the resolution of the photoreceptor may be deteriorated.

[Intermediate Layer 6]

The photoreceptor of the present invention preferably has an intermediate layer between the conductive substrate and the single layer type photosensitive layer or the layered photosensitive layer.

The intermediate layer has a function of preventing injection of a charge from the conductive substrate into the single layer type photosensitive layer or the layered photosensitive layer. That is, the deterioration of a charging property of the single layer type photosensitive layer or the layered photosensitive layer is inhibited, and a decrease in surface charges other than those in an area to be erased by exposure is inhibited, and the occurrence of image defects such as fog is prevented. Particularly, the occurrence of the fog of image, referred to as a black spot in which minute black points consisting of toner are formed on a white background when images are formed by a reversal development process, is prevented.

Further, the intermediate layer with which the surface of the conductive substrate is coated can mitigate a degree of the bumps and dips which are defects of the surface of the conductive substrate to make the surface uniform, and therefore it can enhance a film forming property of the single layer type photosensitive layer or the layered photosensitive layer and improve the adhesion (adhesive property) between the conductive substrate and the single layer type photosensitive layer or the layered photosensitive layer.

The intermediate layer can be formed, for example, by dissolving a resin material in an appropriate solvent to prepare a coating solution for forming the intermediate layer, applying this coating solution onto the surface of the conductive substrate 1, and eliminating the organic solvent by drying.

Examples of the resin material include natural high molecular materials such as casein, gelatin, polyvinyl alcohol, and ethylcellulose in addition to the same binder resins as those contained in the single layer type photosensitive layer, and as the resin material, one or more species of them can be used.

Examples of the solvent, in which the resin material is dissolved or dispersed, include water, alcohols such as methanol, ethanol and butanol, glymes such as methylcarbitol and butylcarbitol, and a mixed solvent prepared by mixing two or more of these solvents.

Other process steps and conditions thereof are similar to those of the single layer type photosensitive layer.

Further, the coating solution for forming the intermediate layer may contain metal oxide particles.

The metal oxide particles can easily control a value of volume resistance of the intermediate layer, can further inhibit the injection of a charge into the single layer type photosensitive layer or the layered photosensitive layer, and can maintain electric characteristics of the photoreceptor in various environments.

Examples of the metal oxide particles include titanium oxide, zinc oxide, aluminum oxide, aluminum hydroxide, and tin oxide.

When a total content of the resin material and the metal oxide particles is denoted by C and a content of the solvent is denoted by D in the coating solution for forming the intermediate layer, a volume ratio (C/D) between the both is preferably 1/99 to 40/60 (weight ratio is 0.01 to 0.67), and particularly preferably 2/98 to 30/70 (weight ratio is 0.02 to 0.43).

Further, a volume ratio (E/F) between a content (E) of the resin material and a content (F) of the metal oxide particles is preferably 1/99 to 90/10 (weight ratio is 0.01 to 9.0), and particularly preferably 5/95 to 70/30 (weight ratio is 0.05 to 2.33).

A film thickness of the intermediate layer is not particularly limited, but it is preferably 0.01 μm to 20 μm, and particularly preferably 0.1 μm to 10 μm. When the film thickness of the intermediate layer is less than 0.01 μm, the intermediate layer does not substantially function as an intermediate layer, and it may be impossible to cover the defects of the conductive substrate to attain a uniform surface, and when the film thickness of the intermediate layer is more than 20 μm, a uniform intermediate layer can be hardly formed and the sensitivity of the photoreceptor may be deteriorated.

In addition, when a constituent material of the conductive substrate is aluminum, it is possible to form a layer including alumite (alumite layer) to use as an intermediate layer.

An image forming apparatus of the present invention is characterized by including the photoreceptor of the present invention, charging means to charge the photoreceptor, exposing means to expose the photoreceptor charged, and developing means to develop an electrostatic latent image formed by exposure, is provided.

The image forming apparatus of the present invention will be described referring to drawings, but the present invention is not limited to the following descriptions.

Figure 9:
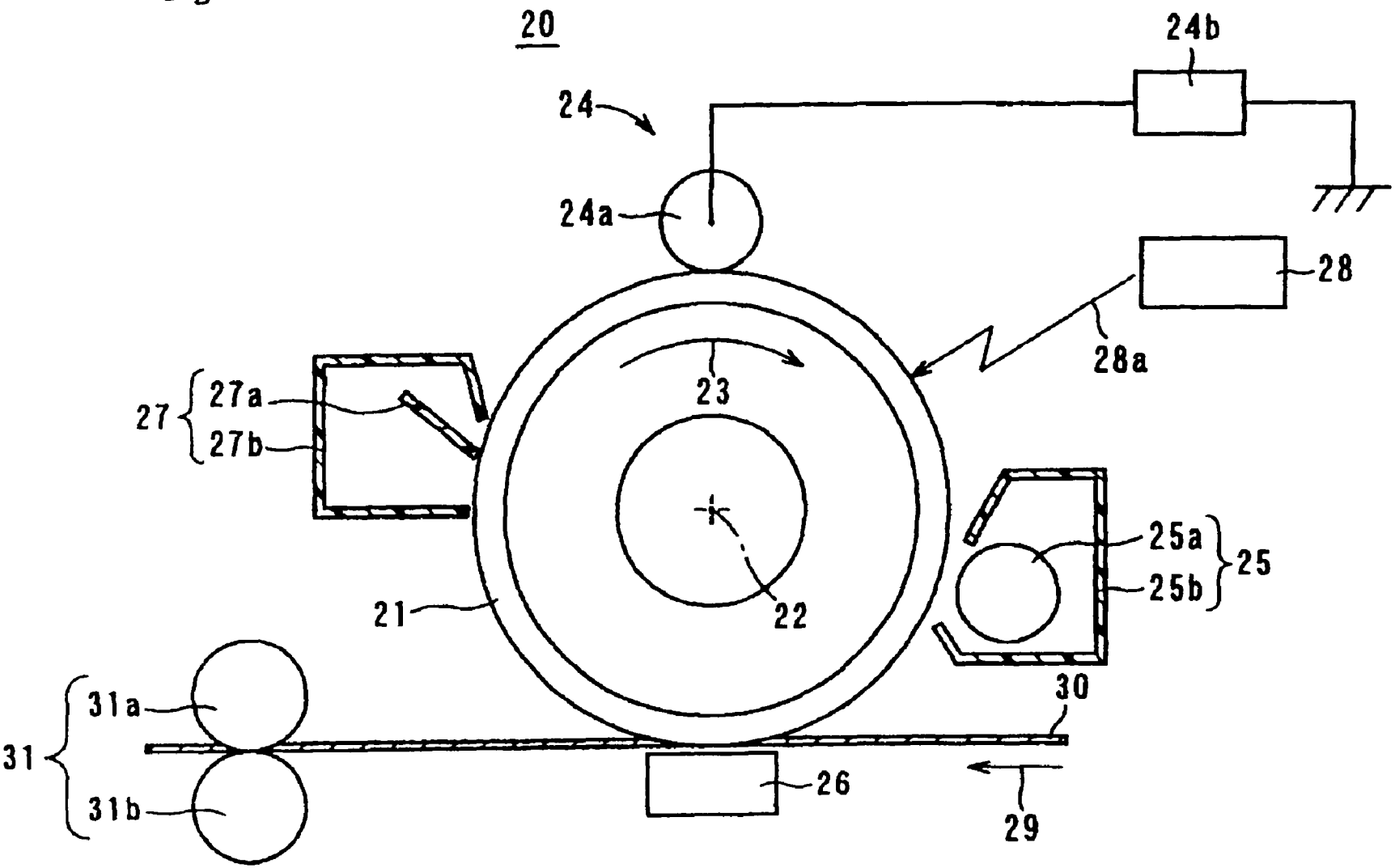
FIG. 9 is a schematic side view showing a constitution of an image forming apparatus of the present invention.

FIG. 9 is a schematic side view showing a constitution of an image forming apparatus of the present invention.

An image forming apparatus 20 in FIG. 9 is composed of a photoreceptor 21 of the present invention (for example, any one of the photoreceptors 11 to 18 in FIGS. 1 to 8), charging means (charger) 24, exposing means 28, developing means (developing device) 25, a transfer device 26, a cleaner 27 and a fixer 31. A reference numeral 30 represents transfer paper.

The photoreceptor 21 is supported rotatably to the main body of the image forming apparatus 20 (not shown), and is rotationally driven in the direction of an arrow 23 about an axis line 22 of rotation with driving means not shown. The driving means is composed of, for example, an electric motor and a reduction gear and rotates the photoreceptor 21 at a predetermined circumferential velocity by transmitting its driving force to the conductive substrate constituting a core body of the photoreceptor 21. The charger 24, the exposing means 28, the developing device 25, the transfer device 26 and the cleaner 27 are installed in this order along the outer circumferential surface of the photoreceptor 21 from upstream of the rotational direction, shown by the arrow 23, of the photoreceptor 21 toward downstream.

The charger 24 is charging means to charge the outer circumferential surface of the photoreceptor 21 to a prescribed potential. In the present embodiment, the charger 24 is realized with a contact charging roller 24*a* and a bias power source 24*b* to apply a voltage to the charging roller 24*a*.

As the charging means, a charger wire can also be used, but the photoreceptor according to the present invention, on which the surface protective layer is formed, exerts a larger effect on the improvement in durability in the charging roller requiring high wear resistance of the surface of the photoreceptor.

Accordingly, in the image forming apparatus of the present invention, the charging means is preferably contact charging.

The exposing means 28 includes, for example, semiconductor laser as a light source, and gives exposure in accordance with image information to the charged outer circumferential surface of the photoreceptor 21 by irradiating with light 28*a* such as laser beams outputted from the light source to an area between the charger 24 and the developing device 25 of the photoreceptor 21. The light 28*a* is repeatedly scanned in a direction in which the axis line 22 of rotation of the photoreceptor 21 is extended, a main scanning direction, and an electrostatic latent image is formed in turn on the surface of the photoreceptor 21 in association with this scanning.

The developing device 25 is developing means which develops the electrostatic latent image formed on the surface of the photoreceptor 21 by exposure with a developer, and is installed in a state of facing the photoreceptor 21. The developing device 25 includes a developing roller 25*a* to supply toner to the outer circumferential surface of the photoreceptor 21, and a casing 25*b* which supports the developing roller 25*a* rotatably about a rotational axis line parallel to the axis line 22 of rotation of the photoreceptor 21 and holds a developer containing toner in its internal space.

The transfer device 26 is transfer means to transfer the toner image as a visible image formed on the outer circumferential surface of the photoreceptor 21 by development onto the transfer paper 30, which is a recording medium, supplied between the photoreceptor 21 and the transfer device 26 from a direction of an arrow 29 by transfer means (not shown). The transfer device 26 is, for example, noncontact transfer means which includes the charging means and transfers the toner image onto the transfer paper 30 by providing the transfer paper 30 with charges opposite in polarity to the toner.

The cleaner 27 is cleaning means to remove and recover toner remaining on the outer circumferential surface of the photoreceptor 21 after a transfer action by the transfer device 26, and includes a cleaning blade 27*a* to peel off the toner remaining on the outer circumferential surface of the photoreceptor 21 and a recovery casing 27*b* to receive the toner peeled off by the cleaning blade 27*a*. Further, this cleaner 27 is installed with an erase lamp (not shown).

Further, in the image forming apparatus 20, the fixer 31, which is fixing means to fix the transferred image, is installed downstream where the transfer paper 30, passing through between the photoreceptor 21 and the transfer device 26, is carried. The fixer 31 includes a heating roller 31*a* having heating means (not shown) and a pressure roller 31*b* which is installed in a state of being opposed to the heating roller 31*a* and pressed by the heating roller 31*a* to form an abutting section.

Image formation operations by this image forming apparatus 20 are performed as follows. First, when the photoreceptor 21 is rotationally driven in the direction of the arrow 23 by driving means, the surface of the photoreceptor 21 is uniformly charged positively or negatively to a prescribed potential by the charger 24 installed above an imaging point of light 28*a* from the exposing means 28 in a rotation direction of the photoreceptor 21.

Next, the light 28*a* in accordance with image information is irradiated to the surface of the photoreceptor 21 from the exposing means 28. In the photoreceptor 21, surface charges in an area to which light 28*a* is irradiated are removed by this exposure, and a difference between the surface potential in an area to which the light 28*a* is irradiated and the surface potential in an area to which the light 28*a* is not irradiated is produced to form an electrostatic latent image.

The toner is supplied from the developing device 25 installed downstream from an imaging point of the light 28*a* from the exposing means 28 in a rotation direction of the photoreceptor 21 to the surface of the photoreceptor 21 on which the electrostatic latent image is formed, and the electrostatic latent image is developed to form a toner image.

The transfer paper 30 is supplied between the photoreceptor 21 and the transfer device 26 in synchronization with the exposure to the photoreceptor 21. Charges opposite in polarity to the toner is given to the supplied transfer paper 30 by the transfer device 26 and the toner images formed on the surface of the photoreceptor 21 are transferred on the transfer paper 30.

The transfer paper 30 on which the toner images are transferred is carried to the fixer 31 by carrying means, and the transfer paper 30 is heated and pressed when it passes through the abutting section of the pressure roller 31*b* to the heating roller 31*a* of the fixer 31 and therefore the toner images are fixed to the transfer paper 30 to become hardened images. The transfer paper 30 on which images are thus formed is discharged out of the image forming apparatus 20 by carrying means.

On the other hand, the toner remaining on the surface of the photoreceptor 21 after the transfer of toner images by the transfer device 26 is peeled off from the surface of the photoreceptor 21 and recovered by the cleaner 27. The charge of the surface of the photoreceptor 21 from which the toner is thus removed is eliminated by light from the erase lamp, and the electrostatic latent image on the surface of the photoreceptor 21 disappears. Thereafter, the photoreceptor 21 is further rotationally driven, and a sequence of actions starting from charging is repeated again to form images sequentially.

The image forming apparatus 20 according to the present invention can form images of high quality without image defects such as white spots since it includes the photoreceptor 21 having the photosensitive layer in which the amine compound of the present invention is uniformly dispersed.

EXAMPLES

Hereinafter, the present invention will be described in more detail by way of production examples, examples and comparative examples, but the present invention is not limited to these production examples (excluding comparative examples) and examples.

In addition, a chemical structure, a molecular weight and elemental analysis of the compounds obtained in production examples were measured by use of the following apparatuses and conditions.

(Chemical Structure)

Molecular weight measuring apparatus: LC-MS (manufactured by ThermoQuest Corp., Finnigan LCQ Deca Mass Spectrometer)

LC column GL-Sciences Inertsil OSD-3 2.1×100 mm

Column temperature 40° C.

Eluate methanol: water=90:10

Sample injection amount 5 μl

Detector UV 254 nm and MS ESI (Elemental Analysis)

Elemental analysis apparatus: Elemental Analysis 2400, manufactured by PerkinElmer Japan Co., Ltd.

Sample amount: about 2 mg precisely weighed

Gas flow rate (ml/min): He=1.5, $O_2$=1.1, $N_2$=4.3

Combustion tube, preset temperature: 925° C.

Reducing tube, preset temperature: 640° C.

In addition, elemental analysis was carried out by a simultaneous determination method of carbon (C), hydrogen (H) and nitrogen (N) based on a differential thermal conductivity method.

Production Example 1

1.07 g (1.0 equivalent weight) of benzylamine and 6.28 g (2.1 equivalent weight) of a bromo-compound having the following structural formula (6), which was formed by brominating Sumilizer BHT (produced by Sumitomo Chemical Co., Ltd.) by a normal method using NBS (N-bromosuccinimide) were added to 150 ml of 1,4-dioxane anhydrous, and the resulting mixture was cooled under ice in a ice bath. In this solution, 2.84 g (2.2 equivalent weight) of N,N-diisopropylethylamine was gradually added. Thereafter, the resulting mixture was heated gradually to a reaction temperature of 100 to 110° C., and the mixture was stirred for 4 hours while keeping a temperature of 100 to 110° C. while heating. After the completion of the reaction, the reaction solution was left standing to cool, and the produced precipitate was separated by filtration and adequately washed with water, dried, and this precipitate was recrystallized in a mixed solvent of ethanol and ethyl acetate (ethanol:ethyl acetate=8:2 to 7:3) to obtain 4.6 g of a white powdery compound.

The obtained white powdery compound was analyzed, and consequently, in a main peak of a mass spectrum of an exemplary compound No. 1 (calculated molecular weight: 543.41) by LC-MS, a peak corresponding a molecular ion $[M]^+$ was observed at 543.7. Further, from the present mass spectrum, and MS/MS spectrum, ion peaks, associated with the following cleavage, having MWs of 528, 486, 452, 324, and 219, were observed.

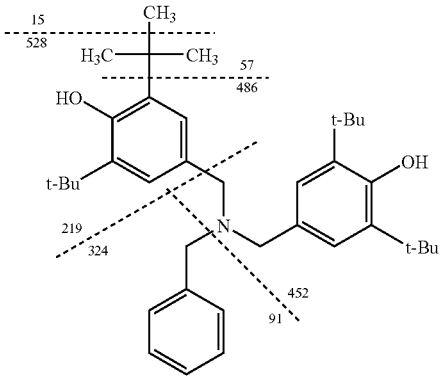

Further, values of elemental analysis of the white powdery compound are as follows.

<Values of Elemental Analysis of Exemplary Compound No. 1>

Theoretical value C: 81.72%, H: 9.82%, N: 2.58%

Actual measurement C: 81.51%, H: 9.68%, N: 2.72%

As described above, it was found from the results of analysis of LC-MS and an elemental analysis that the obtained white powdery compound is an amine compound of the exemplary compound No. 1 (yield 85%). Further, from the results of analysis of HPLC in LC-MS measurement, the purity of the obtained exemplary compound (No. 1) was 99.3%.

Production Examples 2 to 4

Synthesis of Exemplary Compound Nos. 2, 8, 19, 21 and 28

In Production Example 1, each raw material compound shown in Table 2 below was used as an amine compound and an aldehyde compound and the same operations were performed to produce the exemplary compound Nos. 2, 8, 19, 21 and 28. In addition, in the following Table 2, the raw material compound of the exemplary compound No. 1 is shown together.

TABLE 2

| Compound | Amine Compound of General formula (3) | Bromo-compound of General formula (4) or (5) |
|---|---|---|
| Production Example 1 Exemplary compound No. 1 | 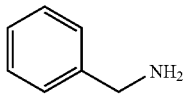 | 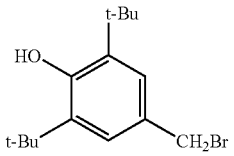 |
| Production Example 2 Exemplary compound No. 2 | 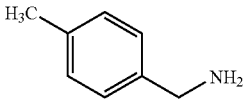 | 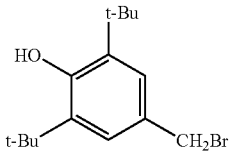 |

TABLE 2-continued

| Compound | Amine Compound of General formula (3) | Bromo-compound of General formula (4) or (5) |
|---|---|---|
| Production Example 3 Exemplary compound No. 8 | 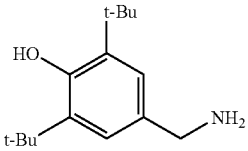 | 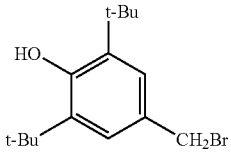 |
| Production Example 4 Exemplary compound No. 19 | 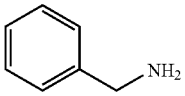 | 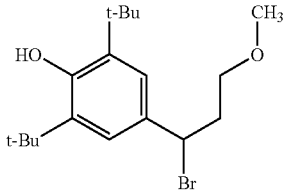 |
| Production Example 5 Exemplary compound No. 21 | 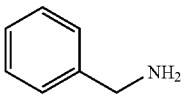 | 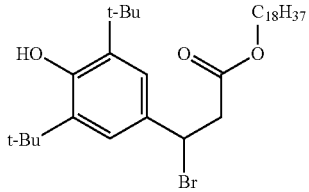 |
| Production Example 6 Exemplary compound No. 28 | 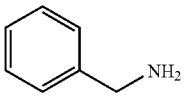 | 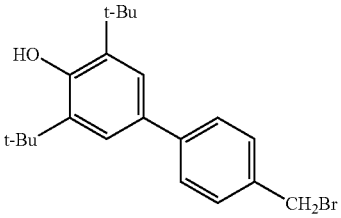 |

Further, elemental analysis values, and calculated values and actual measurements $[M]^+$ by LC-MS of the molecular weight of the respective exemplary compounds obtained in Production Examples 1 to 6 described above are shown in Table 3.

TABLE 3

| Compound | Structural Formula | Elemental analysis C (%) | H (%) | N (%) | LC-MS |
|---|---|---|---|---|---|
| Production Example 1 Exemplary compound No. 1 | 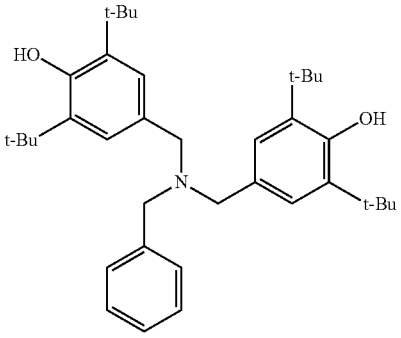 | Theoretical value 81.72 | 9.82 | 2.58 | Calculated value 543.4 |
| | | Found 81.51 | 9.68 | 2.72 | Found $[M]^+$ 543.7 |

TABLE 3-continued

| | | | | | |
|---|---|---|---|---|---|
| Production Example 2 Exemplary compound No. 2 | 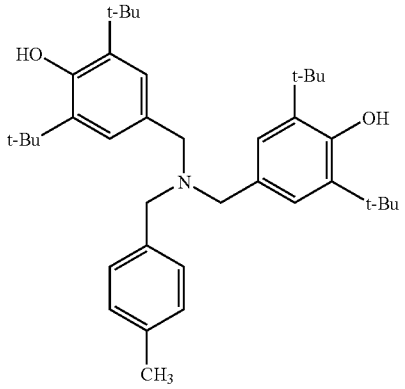 | Theoretical value | 81.82 | 9.94 | 2.51 | Calculated value 557.4 |
| | | Found | 81.59 | 9.90 | 2.53 | Found $[M]^+$ 557.7 |
| Production Example 3 Exemplary compound No. 8 | 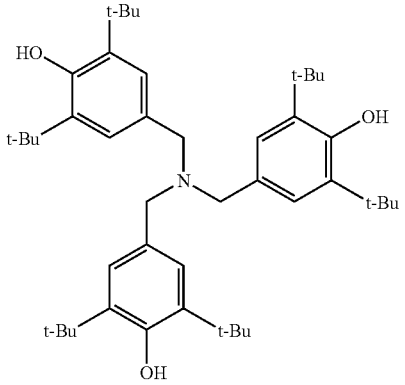 | Theoretical value | 80.42 | 10.35 | 2.08 | Calculated value 671.5 |
| | | Found | 80.25 | 10.29 | 2.12 | Found $[M]^+$ 671.8 |
| Production Example 4 Exemplary compound No. 19 | 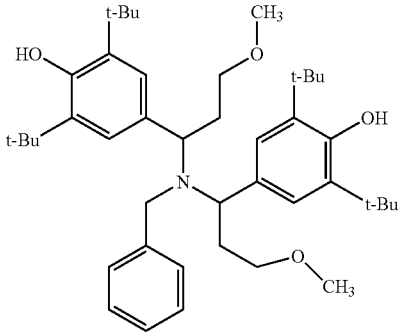 | Theoretical value | 78.25 | 9.93 | 2.12 | Calculated value 659.5 |
| | | Found | 78.05 | 9.89 | 2.21 | Found $[M]^+$ 659.8 |
| Production Example 5 Exemplary compound No. 21 | 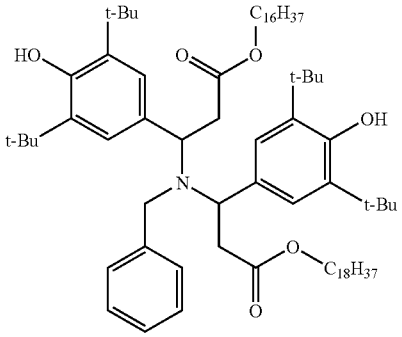 | Theoretical value | 79.39 | 11.16 | 1.20 | Calculated value 1164.0 |
| | | Found | 79.29 | 11.05 | 1.22 | Found $[M]^+$ 1164.3 |

TABLE 3-continued

| | | | | | |
|---|---|---|---|---|---|
| Production Example 6 Exemplary compound No. 28 | 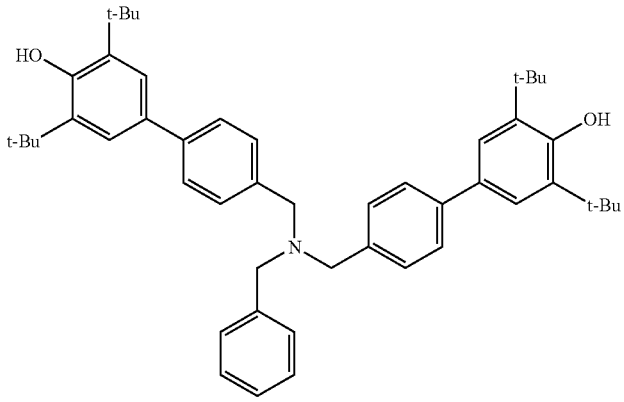 | Theoretical value | | | Calculated value |
| | | 84.56 | 8.83 | 2.01 | 695.5 |
| | | Found | | | Found $[M]^+$ |
| | | 84.48 | 8.78 | 2.10 | 695.8 |

Example 1

In the following manner, a photoreceptor whose charge transporting layer contains the exemplary compound No. 1 produced in Production Example 1, the amine compound of the present invention, was prepared.

7 parts by weight of titanium oxide (trade name: TIPAQUE TTO55A, produced by ISHIHARA SANGYO KAISHA, LTD.) and 13 parts by weight of a copolymerized nylon resin (trade name: AMILAN CM8000, produced by Toray Industries, Inc.) were added to a mixed solvent of 159 parts by weight of methyl alcohol and 106 parts by weight of 1,3-dioxolane, and the resulting mixture was dispersed for 8 hours with a paint shaker to prepare 100 g of a coating solution for forming the intermediate layer. This coating solution for forming the intermediate layer was poured into a coating tank, and an aluminum cylindrical conductive substrate having a diameter of 30 mm and a longitudinal length of 340 mm was immersed into this coating tank and taken out, and dried to form an intermediate layer having a thickness of 1.0 μm on the conductive substrate.

Next, 1 part by weight of X type non-metal phthalocyanine (Fastogen Blue 8120, produced by DAINIPPON INK AND CHEMICALS, Inc.) and 1 part by weight of a butyral resin (trade name: #6000-C, produced by DENKI KAGAKU KOGYO K.K.) were mixed in 98 parts by weight of methyl ethyl ketone, and the resulting mixture was dispersed with a paint shaker to prepare 50 g of a coating solution for forming the charge generation layer. This coating solution for forming the charge generation layer was applied onto the intermediate layer by the same dip coating method as in the previously formed intermediate layer, and dried to form a charge generation layer having a thickness of 0.4 μm.

Next, 2.5 parts by weight of the amine compound of the exemplary compound No. 1 produced in Production Example 1, 100 parts by weight of a charge transporting material expressed by the following structural formula (6) and 180 parts by weight of a polycarbonate resin (trade name: IUPILON Z400, produced by Mithubishi Gas Chemical Co., Inc.) were mixed, and using THF as a solvent, 10 g of a coating solution for forming the charge transporting layer, whose solid content was 20% by weight, was prepared. This coating solution for forming the charge transporting layer was applied onto the charge generation layer previously formed by the same dip coating method as in the previously formed intermediate layer, and dried at a temperature of 130° C. for 1 hour to form two species of charge transporting layers having different film thicknesses of 15 μm and 28 μm, respectively. As described above, a layered photoreceptor according to the present invention having a layered structure formed by stacking the intermediate layer, the charge generation layer and the charge transporting layer in turn on the conductive substrate was prepared as with the aforementioned photoreceptor 17 shown in FIG. 7.

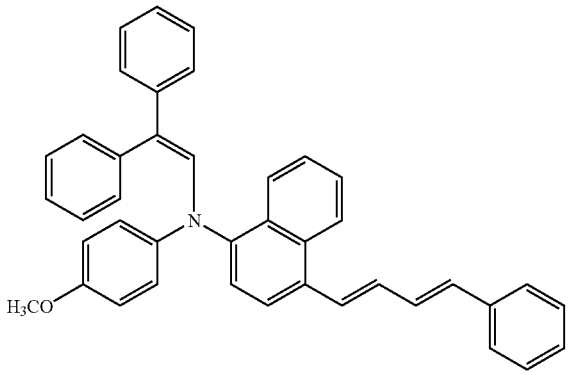

charge transporting material (6)

Examples 2 to 4

A layered photoreceptor according to the present invention having a layered structure formed by stacking the intermediate layer, the charge generation layer and the charge transporting layer in turn on the conductive substrate was prepared by following the same procedure as in Example 1 except for using the exemplary compound Nos. 8, 19 and 28 in place of the exemplary compound No. 1 being the amine compound according to the present invention.

Example 5

A layered photoreceptor according to the present invention having a layered structure formed by stacking the intermediate layer, the charge generation layer and the charge transporting layer in turn on the conductive substrate was prepared by following the same procedure as in Example 1 except for using a compound expressed by the following structural formula (7) as a charge transporting material.

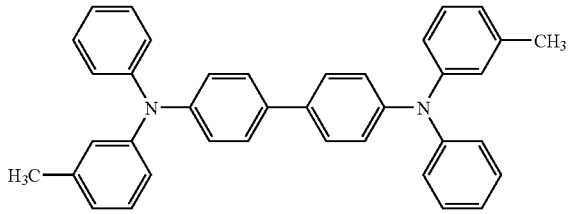

charge transporting material (7)

Example 6

A layered photoreceptor according to the present invention having a layered structure formed by stacking the intermediate layer, the charge generation layer and the charge transporting layer in turn on the conductive substrate was prepared by following the same procedure as in Example 1 except for using 0.1 parts by weight of the amine compound of the exemplary compound No. 1.

Example 7

A layered photoreceptor according to the present invention having a layered structure formed by stacking the intermediate layer, the charge generation layer and the charge transporting layer in turn on the conductive substrate was prepared by following the same procedure as in Example 1 except for using 20 parts by weight of the amine compound of the exemplary compound No. 1.

Comparative Example 1

A layered photoreceptor was prepared by following the same procedure as in Example 1 except for not using the amine compound according to the present invention.

Comparative Example 2

A layered photoreceptor was prepared by following the same procedure as in Example 5 except for not using the amine compound according to the present invention.

Comparative Example 3

A layered photoreceptor was prepared by following the same procedure as in Example 1 except for using tribenzylamine (Japanese Unexamined Patent Publication No. 3-172852) in place of the amine compound according to the present invention.

Comparative Example 4

A layered photoreceptor was prepared by following the same procedure as in Example 1 except for using Sumilizer BHT (produced by Sumitomo Chemical Co., Ltd.) in place of the amine compound according to the present invention.

Comparative Example 5

A layered photoreceptor was prepared by following the same procedure as in Example 1 except for using Irganox 245 (produced by CIBA-GEIGY Corp.) in place of the amine compound according to the present invention.

Comparative Example 6

A layered photoreceptor was prepared by following the same procedure as in Example 1 except for using 20 parts by weight of Sumilizer BHT (produced by Sumitomo Chemical Co., Ltd.) in place of the amine compound according to the present invention.

For the electric characteristics of the photoreceptors in Examples 1 to 7 and Comparative Examples 1 to 6 thus formed, (a) Ozone gas resistance and (b) stability were evaluated according to the following method, and (c) overall determination of photoreceptor performance was performed.

(a) Ozone Gas Resistance

[Evaluation by Evaluation Apparatus]

Each of the photoreceptors for evaluation by evaluation apparatuses (layer thickness of the charge transporting layer: 15 μm) in Examples 1 to 7 and Comparative Examples 1 to 6 was mounted on a copier for test, and a surface potential $V_1$ (V) of the photoreceptor right after charging of the photoreceptor and a surface potential $V_2$ (V) of the photoreceptor after a lapse of three seconds from charging were measured in an environment of normal temperature/normal humidity at a temperature of 25° C. and a relative humidity of 50% (N/N). As the copier for test, an apparatus, which is fabricated by installing a surface potential meter (trade name: CATE-751, manufactured by GENTEC Co., Ltd.) in a commercially available copier AR-F330 (trade name, manufactured by Sharp Corp.) equipped with a corona discharge charger as charging means for the photoreceptor so that the surface potential of the photoreceptor in a process of forming images can be measured, was used. The surface potential $V_1$ (V) right after charging of the photoreceptor and the surface potential $V_2$ (V) after a lapse of three seconds from charging, which were measured, respectively, were substituted into the following equation (I) to determine a retention of charge DD (%) and this retention of charge is taken as an initial retention of charge $DD_0$.

$$\text{Retention of charge } DD\ (\%) = V_2(V)/V_1(V) \times 100 \quad \text{(I)}$$

Next, using an ozone generation and control apparatus (trade name: OES-10A, manufactured by Dylec Inc.), each photoreceptor was exposed to ozone for 20 hours in a hermetically sealed container in which an ozone concentration was adjusted to about 7.5 ppm (verified by an ozone densitometer MODEL 1200 (trade name) manufactured by Dylec Inc.). After exposure to ozone, each photoreceptor was left standing for 2 hours in an environment of normal temperature/normal humidity at a temperature of 25° C. and a relative humidity of 50% (N/N), and a retention of charge DD (%) was determined by following the same procedure as before exposure to ozone, and this is defined as a retention of charge after ozone exposure $DD_{02}$.

A retention of charge before ozone exposure, that is, a value calculated by subtracting the retention of charge after ozone exposure $DD_{02}$ from the initial retention of charge $DD_0$ is defined as a change rate in retention of a charge ΔDD ($=DD_0-DD_{02}$), and a value of ΔDD was determined and used as an evaluation index of ozone gas resistance.

[Evaluation by Actual Equipment]

Each of the photoreceptors for evaluation by actual equipment (layer thickness of the charge transporting layer: 28 μm) in Examples 1 to 7 and Comparative Examples 1 to 6 was mounted on a commercially available copier AR-F330 (trade name, manufactured by Sharp Corp.) equipped with a corona discharge charger as charging means for the photoreceptor, and a test image of a predetermined pattern was actually copied on 50000 sheets of recording paper in an environment of normal temperature/normal humidity at a temperature of 25° C. and a relative humidity of 50% (N/N). The operation of the copier was stopped for 1 hour from the time of completing actual copy of 50000 sheets, and then a half-tone image was duplicated on the recording paper and this duplication was taken as a first evaluation image. Next, again, the test image of a predetermined pattern was actually copied on 50000 sheets of recording paper in an N/N environment of a temperature of 25° C. and a relative humidity of 50%, and the operation of the copier was stopped for 1 hour from the time of completing actual copy of 50000 sheets, and then a half-tone image was duplicated on the recording paper and this duplication was taken as a second evaluation image.

The formed first evaluation image and the second evaluation image were visually observed, and the image quality of an area of the recording paper corresponding to a portion to which the toner image is transferred from an area of the photoreceptor located close to the corona discharge charger when the operation of the copier was stopped was judged depending on the frequency of occurrence of image defects such as a white spot and a black stripe and used as an evaluation index of ozone gas resistance. Evaluation criteria of the image quality are as follows.

⊙: Excellent (There is no image defect in both the first evaluation image and the second evaluation image)

○: Good (There are some image defects in either the first evaluation image or the second evaluation image or both, but a level of the defects can be neglected)

Δ: Allowable (There are some image defects in either the first evaluation image or the second evaluation image or both, but a level of the defects arises practically no problem)

x: Bad (There are many image defects in either the first evaluation image or the second evaluation image or both, and it is impractical)

Considering values of the change rate in retention of a charge ADD and judgment of image quality described above comprehensively, ozone gas resistance of the photoreceptor was evaluated. Evaluation criteria of the ozone gas resistance are as follows.

⊙: Excellent (ΔDD is less than 3.0% and image quality is excellent (⊙))

○: Good (ΔDD is 3.0% or more and less than 7.0% and image quality is excellent (⊙), or ADD is less than 7.0% and image quality is good (○))

Δ: Practically no problem (ADD is less than 7.0% and image quality is allowable (Δ))

x: Defective (ADD is 7.0% or more, or image quality is bad (x))

(b) Stability of Electric Characteristic

Each of the photoreceptors for evaluation by actual equipment (layer thickness of the charge transporting layer: 28 μm) in Examples 1 to 7 and Comparative Examples 1 to 6 was mounted on a copier for test, and stability of electric characteristics was evaluated in the following manner in an environment of low temperature/low humidity at a temperature of 5° C. and a relative humidity of 20% (L/L) and an environment of high temperature/high humidity at a temperature of 35° C. and a relative humidity of 85% (H/H). As the copier for test, an apparatus, which is fabricated by installing a surface potential meter (trade name: CATE-751, manufactured by GENTEC Co., Ltd.) in a commercially available copier AR-F330 (trade name, manufactured by Sharp Corp.) equipped with a corona discharge charger as charging means for the photoreceptor so that the surface potential of the photoreceptor in a process of forming images can be measured, was used. In addition, the copier AR-F330 is a negatively charged image forming apparatus in which the surface of the photoreceptor is negatively charged to perform an electrophotographic process.

A copier for test on which the photoreceptors in Examples 1 to 7 and Comparative Examples 1 to 6 were mounted was used, and a surface potential of the photoreceptor right after charging action by a charger was measured as a charging potential V0 (V) and this was taken as an initial charging potential $V0_1$. Further, a surface potential of the photoreceptor right after exposing by laser light was measured as a residual potential Vr (V) and this was taken as an initial residual potential $Vr_1$.

Next, a test image of a predetermined pattern was copied on 300000 sheets of recording paper sequentially, and then the charging potential V0 and the residual potential Vr were measured in the same manner as in the initial potential, and the charging potential after repeating these operations was taken as $V0_2$ and the residual potential after repeating these operations was taken as $Vr_2$. An absolute value of a difference between the initial charging potential $V0_1$ and the charging potential $V0_2$ after repeating operations was defined as a change rate in a charging potential $\Delta V0(=|V0_1-V0_2|)$ and a value of ΔV0 was determined. Further, an absolute value of a difference between the initial residual potential $Vr_1$ and the residual potential $Vr_2$ after repeating operations was defined as a change rate in a residual potential $\Delta Vr\ (=|Vr_1-Vr_2|)$ and a value of ΔVr was determined. The change rate in a charging potential ΔV0 and the change rate in a residual potential ΔVr were used as evaluation indices, and stability of electric characteristics was evaluated.

Evaluation criteria of stability of electric characteristics in an L/L environment are as follows.

⊙: Excellent (ΔV0 is 35 V or less and ΔVr is 55 V or less)

○: Good (ΔV0 is 35 V or less and ΔVr is more than 55 V and 80 V or less, or ΔV0 is more than 35 V and 75 V or less and ΔVr is 55 V or less)

Δ: Practically no problem (ΔV0 is more than 35 V and 75 V or less and ΔVr is more than 55 V and 80 V or less)

x: Defective (ΔV0 is more than 75 V, or ΔVr is more than 80 V)

Evaluation criteria of stability of electric characteristics in an H/H environment are as follows.

⊙: Excellent (ΔV0 is 15 V or less and Vr is 50 V or less and ΔVr is 105 V or less)

○: Good (ΔV0 is 15 V or less and Vr is 50 V or less and ΔVr is more than 105 V and 125 V or less, or ΔV0 is more than 15 V and 30 V or less and Vr is 50 V or less and ΔVr is 105 V or less)

Δ: Practically no problem (ΔV0 is more than 15 V and 30 V or less and Vr is more than 50 V and 70 V or less and ΔVr is more than 105 V and 125 V or less)

x: Defective (ΔV0 is more than 30 V, Vr is more than 70 V, or ΔVr is more than 125 V)

Further, considering evaluation results in an L/L environment and evaluation results in an H/H environment together, stability of electric characteristics was evaluated comprehensively. Evaluation criteria of comprehensive evaluation of stability of electric characteristics are as follows.

⊙: Excellent (Results in both an L/L environment and an H/H environment are excellent (⊙))

○: Good (Results in one of an L/L environment and an H/H environment are good (○) and results in the other are excellent (⊙) or good (○))

Δ: Practically no problem (Results in one of an L/L environment and an H/H environment are practically no problem (Δ) and results in the other are not defective (x))

x: Defective (Results in one or both of an L/L environment and an H/H environment are defective (x))

(c) Comprehensive Judgment of Photoreceptor Performance

Considering evaluation results of ozone gas resistance and comprehensive evaluation results of stability of electric characteristics together, photoreceptor performance was judged comprehensively. Judgment criteria of comprehensive judgment are as follows.

⊙: Excellent (Both ozone gas resistance and stability of electric characteristics are excellent (⊙))

○: Good (One of ozone gas resistance and stability of electric characteristics is good (○) and the other is excellent (⊙) or good (○))

Δ: Practically no problem (One of ozone gas resistance and stability of electric characteristics is practically no problem (Δ) and the other is not defective (x))

x: Defective (One or both of ozone gas resistance and stability of electric characteristics are defective (x))

The results of the aforementioned evaluations are shown in Table 4.

TABLE 4

| Example | Amine compound; Exemplified compound No. | Amine compound; additive amount (%) of exemplified compound | Charge transporting material compound No. | Evaluation of gas resistance characteristic: Initial charge retaintivity (DD) | Variation in change retaintivity (ΔDD) | Image quality | Evaluation | Electric characteristic after repeated usage: L/L potential characteristic Vo | ΔVo |
|---|---|---|---|---|---|---|---|---|---|
| 1 | 1 | 2.5 | 6 | 91.2 | 2.5 | ⊙ | ⊙ | −673 | 25 |
| 2 | 8 | 2.5 | 6 | 90.9 | 2.6 | ⊙ | ⊙ | −672 | 25 |
| 3 | 19 | 2.5 | 6 | 91.5 | 2.7 | ⊙ | ⊙ | −675 | 30 |
| 4 | 28 | 2.5 | 6 | 90.8 | 2.0 | ⊙ | ⊙ | −671 | 28 |
| 5 | 1 | 2.5 | 7 | 91.8 | 2.0 | ⊙ | ⊙ | −676 | 26 |
| 6 | 1 | 0.1 | 6 | 90.8 | 2.9 | ⊙ | ⊙ | −671 | 33 |
| 7 | 1 | 20 | 6 | 92.6 | 1.8 | ⊙ | ⊙ | −680 | 20 |
| Comparative Example 1 | — | — | 6 | 90.5 | 21.3 | X | X | −670 | 80 |
| Comparative Example 2 | — | — | 7 | 90.8 | 32.2 | X | X | −671 | 98 |
| Comparative Example 3 | Tribenzylamine | 2,.5 | 6 | 91.1 | 4.3 | Δ | Δ | −672 | 59 |
| Comparative Example 4 | Sumilizer BHT | 2,.5 | 6 | 89.8 | 15.2 | X | X | −666 | 42 |
| Comparative Example 5 | Irganox 245 | 2,.5 | 6 | 90.1 | 7.9 | X | X | −668 | 34 |
| Comparative Example 6 | Sumilizer BHT | 20 | 6 | 90.1 | 4.0 | ○ | ○ | −668 | 32 |

| Example | Electric characteristic after repeated usage: L/L potential characteristic ΔVr | Evaluation | H/H potential characteristic Vo | ΔVo | Vr | ΔVr | Evaluation | General evaluation | General evaluation |
|---|---|---|---|---|---|---|---|---|---|
| 1 | 35 | ⊙ | −656 | 12 | −30 | 62 | ⊙ | ⊙ | ⊙ |
| 2 | 38 | ⊙ | −653 | 12 | −28 | 58 | ⊙ | ⊙ | ⊙ |
| 3 | 32 | ⊙ | −659 | 15 | −35 | 65 | ⊙ | ⊙ | ⊙ |
| 4 | 35 | ⊙ | −652 | 14 | −35 | 65 | ⊙ | ⊙ | ⊙ |
| 5 | 31 | ⊙ | −662 | 12 | −32 | 69 | ⊙ | ⊙ | ⊙ |
| 6 | 35 | ⊙ | −652 | 19 | −30 | 73 | ○ | ⊙ | ⊙ |
| 7 | 36 | ⊙ | −670 | 10 | −52 | 60 | ○ | ⊙ | ⊙ |
| Comparative Example 1 | 82 | X | −649 | 52 | −33 | 120 | X | X | X |
| Comparative Example 2 | 78 | X | −652 | 60 | −35 | 158 | X | X | X |
| Comparative Example 3 | 53 | ○ | −655 | 25 | −35 | 110 | Δ | Δ | Δ |
| Comparative Example 4 | 46 | Δ | −642 | 22 | −31 | 72 | ○ | Δ | X |
| Comparative Example 5 | 38 | ⊙ | −645 | 19 | −32 | 68 | ○ | ○ | X |
| Comparative Example 6 | 38 | ⊙ | −645 | 18 | −140 | 69 | X | X | X |

It is evident from the comparison between Examples 1 to 5 and Comparative Examples 1 and 2 that the photoreceptors of Examples 1 to 5 containing the amine compound according to the present invention have excellent ozone gas resistance and excellent stability of electric characteristics compared with the photoreceptors of Comparative Examples 1 and 2 not containing the amine compound according to the present invention, and exhibit good electric characteristics even in repeated use.

Further, it is evident that the photoreceptors of Examples 1 to 5 exhibit even performance for charge transporting materials having different skeletons and have a wide application range for various charge transporting materials.

Furthermore, it is evident from Examples 6 and 7 that when an addition amount of the amine compound according to the present invention is in a range of 0.1 to 20 parts by weight with respect to 100 parts by weight of the charge transporting material, the photoreceptors exhibit good results.

It is evident from the comparison between Example 1 and Comparative Example 3 that the publicly known amine base additive proposed for the same purpose as in the present invention exhibited apparent difference in effects when evaluating also the image quality of the amine compounds and the photoreceptor of Example 1 using the amine compound of the present invention is superior to that of Comparative Example 3.

Further, it is evident from the comparison between Example 1 and Comparative Examples 4 to 6 that the hindered phenol-based antioxidant prevents the deterioration of electric characteristics but is less effective against white spots. Furthermore, if a large amount of the antioxidant is added in order to improve image quality, an initial electric characteristic is significantly deteriorated. Therefore, it can be verified that the amine compound of the present invention can effectively prevent the deterioration of image quality and electric characteristics.

As described above, the photoreceptor, which has excellent electric characteristics such as a charging property and responsivity and excellent ozone gas resistance, and has excellent characteristic stability in which good electric characteristics described above is not deteriorated even in repeated use, could be obtained by adding the amine compound expressed by the general formula (1) to the photoreceptor.

Since the photoreceptor according to the present invention can provide images of high quality even in a high-speed electrophotographic process, in the image forming apparatus according to the present invention, it is possible to speed up a rate of image formation.

What is claimed is:

1. An electrophotographic photoreceptor comprising a conductive substrate made of a conductive material and a photosensitive layer containing a charge generating material and a charge transporting material, provided on the conductive substrate, wherein the photosensitive layer contains an amine compound of a hindered phenol structure, having the following general formula (1) or (2):

(1)

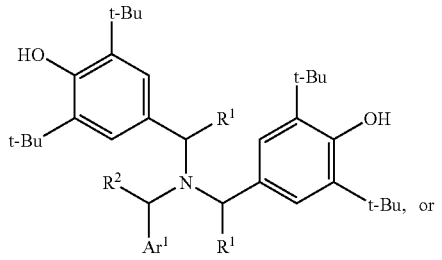

(2)

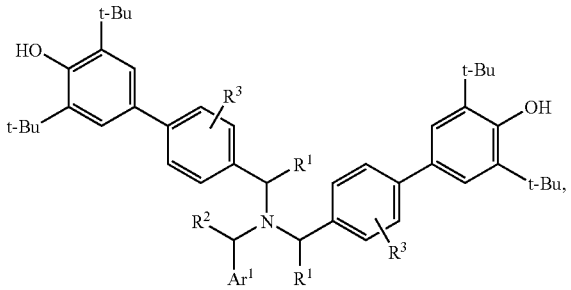

wherein $Ar^1$ represents a phenyl or p-methylphenyl group $R^1$ in the general formula (1) represents an alkyl group optionally having a substituent, $R^1$ in the general formula (2) represents a hydrogen atom or an alkyl group optionally having a substituent, $R^2$ represents a hydrogen atom, and $R^3$ represents a hydrogen atom, an alkyl group optionally having a substituent, an alkoxy group optionally having a substituent or a halogen atom.

2. The electrophotographic photoreceptor according to claim 1, wherein the photosensitive layer is a layered photosensitive layer of a charge generation layer containing a charge generating material and a charge transporting layer containing a charge transporting material or a photosensitive layer being a single layer, containing a charge generating material and a charge transporting material.

3. The electrophotographic photoreceptor according to claim 1, wherein a ratio A/B of a weight A of the charge transporting material to a weight B of the amine compound expressed by the general formula (1) or the general formula (2) is 100/0.1 or more and 100/20 or less.

4. The electrophotographic photoreceptor according to claim 1, further having an intermediate layer between the conductive substrate and the photosensitive layer.

5. An image forming apparatus comprising the electrophotographic photoreceptor according to claim 1, a charging means to charge the electrophotographic photoreceptor, an exposing means to expose the said charged electrophotographic photoreceptor charged, and a developing means to develop an electrostatic latent image formed by exposure.

6. The image forming apparatus according to claim 5, wherein the charging means is contact charging.

* * * * *